US007750257B2

(12) United States Patent
Lindsey et al.

(10) Patent No.: US 7,750,257 B2
(45) Date of Patent: Jul. 6, 2010

(54) MOLDED POLYMER LOAD TAP CHANGER

(75) Inventors: Kurt L. Lindsey, West Allis, WI (US); Rick Alan Rachwal, Pewaukee, WI (US); Richard M. Marusinec, Delafield, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/859,607

(22) Filed: Jun. 3, 2004

(65) Prior Publication Data

US 2005/0269191 A1 Dec. 8, 2005

(51) Int. Cl.
*H01H 19/58* (2006.01)

(52) U.S. Cl. ..... 200/11 TC; 200/17 R

(58) Field of Classification Search ..... 200/11 TC, 200/17 R, 18, 11 C; 323/341
See application file for complete search history.

(56) References Cited

U.S. PATENT DOCUMENTS 3,153,188 A 10/1964 McCarty
3,761,650 A * 9/1973 Fohrhaltz ..... 200/17 R
3,764,891 A * 10/1973 Lingenfelter et al. ..... 323/341
3,875,354 A * 4/1975 Dusek ..... 200/11 TC
3,997,748 A * 12/1976 Harris ..... 218/123
4,061,963 A 12/1977 Green
4,107,637 A * 8/1978 Guidosh ..... 336/150
4,207,445 A 6/1980 Hammar
4,471,334 A * 9/1984 Watanabe et al. ..... 336/150
4,504,811 A * 3/1985 Stunzi ..... 336/10
4,527,022 A * 7/1985 Vazquez ..... 200/8 R
4,595,806 A 6/1986 Itoh
5,056,377 A 10/1991 Yatchum et al.
5,180,050 A * 1/1993 Rada et al. ..... 200/329
5,191,179 A 3/1993 Yatchum et al.
5,488,212 A * 1/1996 Fukushi et al. ..... 200/400
5,523,535 A 6/1996 Larsson et al.
5,594,223 A * 1/1997 Fukushi et al. ..... 218/120

(Continued)

FOREIGN PATENT DOCUMENTS

DE 4016428 11/1991

(Continued)

OTHER PUBLICATIONS

McGraw-Edison, "Voltage Regulators", Jun. 1998, Cooper Power Systems, 225-10, pp. 1-8.

(Continued)

*Primary Examiner*—Renee Luebke
*Assistant Examiner*—Lisa Klaus
(74) *Attorney, Agent, or Firm*—Fish & Richardson P.C.

(57) ABSTRACT

A load tap changer connected to a power source to control voltage supplied from the power source to a load includes a base assembly that includes a base element onto which multiple stationary contacts that connect to taps of a winding of an electrical control device are mounted. The load tap changer also includes a movable assembly that includes a movable element that rotates to connect at least one pair of movable contacts mounted on the movable element to a stationary contact to select a corresponding tap. The load tap changer also includes a cover assembly that includes a cover element onto which a motor that rotates the movable element relative to the base assembly is mounted.

89 Claims, 14 Drawing Sheets

U.S. PATENT DOCUMENTS

| | | | | | |
|---|---|---|---|---|---|
| 5,619,121 | A | * | 4/1997 | Trainor | 323/256 |
| 5,693,922 | A | * | 12/1997 | Tuohy et al. | 200/17 R |
| 5,744,764 | A | | 4/1998 | Aschenbrenner et al. | |
| 5,821,716 | A | * | 10/1998 | Okanik | 318/478 |
| 5,834,717 | A | * | 11/1998 | Neumeyer et al. | 200/17 R |
| 6,060,669 | A | | 5/2000 | Dohnal et al. | |
| 6,091,032 | A | | 7/2000 | Dohnal et al. | |
| 6,693,247 | B1 | | 2/2004 | Byers et al. | |
| 6,833,518 | B1 | * | 12/2004 | Byers et al. | 200/11 TC |
| 6,849,813 | B1 | * | 2/2005 | Albrecht | 200/11 TC |

FOREIGN PATENT DOCUMENTS

| | | | |
|---|---|---|---|
| EP | 0 774 315 | | 5/1997 |
| JP | 2004023026 | * | 6/2002 |

OTHER PUBLICATIONS

McGraw-Edison, "Tap Changer", Jun. 1998, S225-10-10, pp. 5-1 to 5-4.

EPO Examination Report from Application No. 05 757 184.6-2214, dated Feb. 6, 2008 (4 total pages).

Supplementary European Search Report from related Application No. EP 05757184 mailed Oct. 15, 2007 (5 total pages).

* cited by examiner

210

215

MOLDED POLYMER LOAD TAP CHANGER

TECHNICAL FIELD

This document relates to load tap changers for use in electrical control devices such as voltage regulators and transformers that control the transfer of voltages to loads

BACKGROUND

An electrical control device may be used to regulate electricity received from a distribution system that distributes electricity generated by a power source. For example, the electrical control device, which may be a transformer or a step voltage regulator, may regulate the received electricity to maintain a substantially constant voltage on an output of the electrical control device even though the voltage on an input to the electrical control device may be varying. The electrical control device may use a load tap changer to maintain the substantially constant voltage on the output. A load tap changer is a device that employs a secondary circuit voltage detector to actuate a mechanical linkage to selectively engage taps of a tapped section of a winding of the electrical control device in response to voltage variations in order to control the voltage on the output of the electrical control device while the electrical control device is under load.

SUMMARY

In one general aspect, a load tap changer connected to a power source to control voltage supplied from the power source to a load includes a base assembly having a base element. Multiple stationary contacts that connect to taps of a winding of an electrical control device are mounted on the base element. The load tap changer also includes a movable assembly that includes a movable element that rotates to connect at least one pair of movable contacts mounted on the movable element to a stationary contact to select a corresponding tap. The load tap changer also includes a cover assembly that includes a cover element onto which a motor that rotates the movable element relative to the base assembly is mounted.

Implementations may include one or more of the following features. For example, the multiple stationary contacts may include a stationary reversing contact that is connected to an end tap of the electrical control device. The base assembly may include a reversing assembly that includes a reversing element onto which two movable reversing contacts that connect the stationary reversing contact to a neutral stationary contact are mounted.

The reversing element may be made of molded polymer. The reversing element may include contact pockets into which the reversing movable contacts are mounted. Notches in the reversing movable contacts may mate with side walls of the contact pockets to hold the reversing movable contacts within the contact pockets. The reversing assembly may include compression springs that hold the reversing movable contacts in the contact pockets of the reversing element. The contact pockets and the reversing movable contacts may include spring retention features to hold the compression springs within the contact pockets.

The reversing assembly may include a mounting pole connected to the neutral stationary contact and about which the reversing element rotates. The reversing element may include a protrusion that activates logic switches mounted to the cover assembly.

The reversing element may include a reversing arm that is engaged to rotate the reversing element. The movable assembly may include a roller bearing that engages the reversing arm to rotate the reversing element. The roller bearing may rotate about a pin that extends through the movable assembly. The reversing element may include curved edges that match the outer circumference of the movable assembly such that the reversing element is only rotated when the roller bearing engages the reversing arm. The reversing element may include stops that limit rotation of the movable assembly past maximum or minimum allowable tap positions.

Each of the multiple stationary contacts may include a contact face that is connected to a conducting rod. The contact face of each of the multiple stationary contacts may be mounted in a molded pocket on a front side of the base element. The conducting rod of each of the multiple stationary contacts may extend through the base element to connect to one of the electrical control device taps on a back side of the base element. Each conducting rod may be threaded and may be secured to the base assembly with a nut and a washer.

The base element may be made of molded polymer. The base element may include an insulating wall to insulate the motor from the stationary and movable contacts. The base element also may include a hole into which the movable element fits to allow rotation of the movable element relative to the base assembly. The base element may include slots that allow for fluids to flow through the base element.

The stationary contacts may be disposed in a circumferential ring around an edge of the base element. The stationary contacts may have a tungsten-copper composite leading edge.

The base assembly may include a first stationary contact disk that connects to one end of a bridging reactor. The first stationary contact disk may be connected to the base assembly with conducting rods. The base assembly also may include a second stationary contact disk that connects to an opposite end of the bridging reactor. The first stationary contact disk and the second stationary contact disk may be made of copper or plated copper, such as nickel-plated copper.

The second stationary contact disk may be connected to the base assembly on top of the first stationary contact disk such that conducting rods of the second stationary contact disk fit through holes in the first stationary contact disk. The conducting rods of the second stationary contact disk may fit into bosses molded into the base element.

The first stationary contact disk and the second stationary contact disk may be connected to the stationary contacts by the movable contacts. The first stationary contact disk and the second stationary contact disk may both include a hole through which the movable assembly is mated with the base assembly.

The movable element may be made of molded polymer. The movable element may include multiple Geneva gear slots molded into a top side of the movable element that are engaged to cause rotation of the movable element. The movable element may include multiple locking slots molded into a top side of the movable element that are engaged to prevent rotation of the movable element and to properly orient the movable assembly.

The movable element may include contact pockets into which each of the movable contacts is mounted. Notches in the movable contacts may mate with side walls of the contact pockets to hold the movable contacts within the contact pockets. The movable assembly may include compression springs that hold the movable contacts in the contact pockets of the movable element. The movable contacts may include spring retention features to hold the compression springs within the contact pockets. The movable assembly may include contact wearplates within the contact pockets of the movable assembly. The contact wearplates may include spring retention features. The movable contacts may each include a pivot on which the movable contacts rock within the contact pockets. Compression springs of the movable assembly may be located farther within the contact pockets than the pivots of the movable contacts.

The movable element may include a slot configured to receive a rotating component that is to rotate with the movable element. The rotating component may be an indicator cam that indicates an orientation of the movable assembly.

The movable element may include pivot points about which the movable element rotates.

The movable element may include stop features that encounter stops on a reversing assembly to prevent rotation of the movable assembly past maximum or minimum allowable positions.

Each end of the movable contacts may have tips made from composite materials to retard erosion of the movable contacts. The tips may be made of a tungsten-copper composite. Parts of the movable contacts separate from the tips may have single-piece, solid copper cross sections. Two pairs of movable contacts may be mounted on the movable element.

The cover element may be made of molded polymer, and may include a terminal block to which input control wiring is connected.

The motor may be an alternating current synchronous motor. A motor gear may be coupled to the motor. The motor gear may include a hex feature that may be accessed to manually rotate the motor gear. The hex feature may be accessed through a hole in the cover element. The motor gear may directly drive a Geneva drive gear mounted on the cover element that causes the movable element to rotate. The Geneva drive gear and the movable element may be configured such that a 360° rotation of the Geneva drive gear produces a 20° rotation of the movable element. The Geneva drive gear may include a pin that engages Geneva gear slots on the movable element to drive the rotation of the movable element relative to the base assembly. The pin of the Geneva drive gear may include a hardened steel pin and a hardened steel roller that rotates about the hardened steel pin. The Geneva drive gear may include a locking feature, which may be made of polymer, that mates with locking slots on the movable element to prevent the movable element from rotating and to properly orient the movable assembly.

The cover assembly may include a polymer position indicator cam rotated by the motor from which a pin extends. The cover assembly also may include a polymer position indicator Geneva gear that rotates in response to the pin of the position indicator cam entering and exiting slots on the position indicator Geneva gear as the position indicator cam rotates. The cover assembly also may include a position indicator tube that rotates as the position indicator Geneva gear rotates to move an indicator on a dial of the position indicator. A Geneva drive gear may have a molded shaft that extends through the cover element and mates with the position indicator cam to couple the rotation of the position indicator cam to the Geneva drive gear.

The cover assembly may include limit switches and logic switches that de-energize the motor to prevent the movable element from rotating into mechanical stops. The limit switches may be activated by an indicator cam inserted into a slot in the center of the movable element. The limit switches may be included in a limit switch module that includes a dial on which an indicator arrow on the indicator cam indicates a currently selected tap. The logic switches may be activated by a protrusion of a reversing assembly.

The cover assembly may include a neutral indicating switch that is activated by a protrusion of a reversing assembly when the movable assembly is in an orientation in which a neutral tap is selected.

The cover element may include a stabilization feature that stabilizes a reversing assembly as the reversing assembly rotates. The cover element and the base element may include electrical barriers that provide minimal clearance between live components and grounded support features.

The motor may be connected to a capacitor and to a resistor that are mounted on the cover element.

The electrical control device may be a transformer or a step voltage regulator.

In another general aspect, selecting a tap of an electrical control device with a load tap changer includes providing a base assembly that includes a base element onto which stationary contacts connected to taps of a tapped section of an electrical control device are mounted. A signal is received from a control apparatus of the electrical control device to select a tap of the electrical control device. A motor mounted on a cover element of a cover assembly and coupled to the control apparatus is energized in response to the signal. A movable assembly that includes a movable element onto which movable contacts are mounted is rotated relative to the base assembly in response to the energization of the motor to cause the movable contacts to engage the stationary contacts, thereby selecting a tap connected to the electrical control device.

Implementations may include one or more of the following features. For example, rotating the movable assembly in response to the energization of the motor may include rotating a motor gear mounted on an output device of the motor in response to the energization of the motor, rotating a Geneva drive gear mounted on the cover element in response to the rotation of the motor gear, and rotating the movable assembly relative to the base assembly in response to the rotation of the Geneva drive gear to cause the movable contacts to engage the stationary contacts.

Rotating the motor gear in response to the energization of the motor may include rotating the motor gear in a direction indicated by the signal in response to the energization of the motor.

Rotating the movable assembly relative to the base assembly in response to the rotation of the Geneva drive gear may include engaging a pin on the Geneva drive gear with a Geneva gear slot on the movable element, rotating the movable assembly in response to motion of the pin, engaging a locking feature of the Geneva drive gear with a locking slot on the movable element, and preventing rotation of the movable assembly when the locking feature is engaged with the locking slot.

Holding switches mounted on the cover element may be activated to cause the motor to remain energized after the signal from the control apparatus is removed. The holding switches may be deactivated to de-energize the motor after the tap has been selected.

A position indicator may be driven in response to the rotation of the movable assembly. Driving a position indicator in response to the rotation of the movable assembly may include rotating a position indicator cam mounted on the cover element and driven by the motor, rotating a position indicator Geneva gear mounted on the cover element in response to the rotation of the position indicator cam, rotating a position indicator tube mounted on the cover element in response to the rotation of the position indicator Geneva gear, and updating a position indicated by the position indicator in response to the rotation of the position indicator tube.

Rotating the movable assembly relative to the base assembly in response to the signal to cause the movable contacts to engage the stationary contacts may include rotating the movable assembly until one pair of movable contacts has disengaged from a previously engaged stationary contact, and rotating the movable assembly until the one pair of movable contacts has engaged with an adjacent stationary contact.

A reversing assembly may be rotated relative to the base assembly to change a polarity of the tapped section of the electrical control device. Rotating the reversing assembly may include engaging a bearing on the movable assembly with an arm on the reversing assembly, moving the bearing as the movable assembly rotates, and rotating the reversing assembly in response to the motion of the bearing. Stationary reversing contacts connected to end taps of the tapped section to a neutral stationary contact connected to a neutral tap of the tapped section may be connected to movable reversing contacts included in the reversing assembly.

The motor may be de-energized when the movable assembly has rotated to a maximum allowable position. De-energizing the motor when the movable assembly has rotated to a maximum allowable position may include using limit switches and logic switches mounted on the cover element to determine when the movable assembly has rotated to the maximum allowable position, and de-energizing the motor when the limit switches and logic switches indicate that the movable assembly has rotated to the maximum allowable position.

The load tap changer includes molded polymer components, such as the base element, the movable element, and the cover element, that are relatively inexpensive to manufacture and easy to assemble. In addition, the molded polymer components do not require electrical clearance or insulation from electrically live components, which reduces the size of the load tap changer. Multiple components may be combined into a single polymer component or a reduced number of polymer components, which reduces the number of components in the load tap changer. The alternating current (AC) synchronous motor used by the load tap changer to drive the movable contacts does not require an external braking mechanism because the motor stops immediately when power is withdrawn. The load tap changer uses a direct gear drive system that requires minimal space and maintenance, which also reduces the size and operating costs of the load tap changer. In addition, the various plastic components lead to quieter operation of the load tap changer.

Other features will be apparent from the description and drawings, and from the claims.

DESCRIPTION OF DRAWINGS

Like reference symbols in the various drawings indicate like elements.

DETAILED DESCRIPTION

Figure 1:
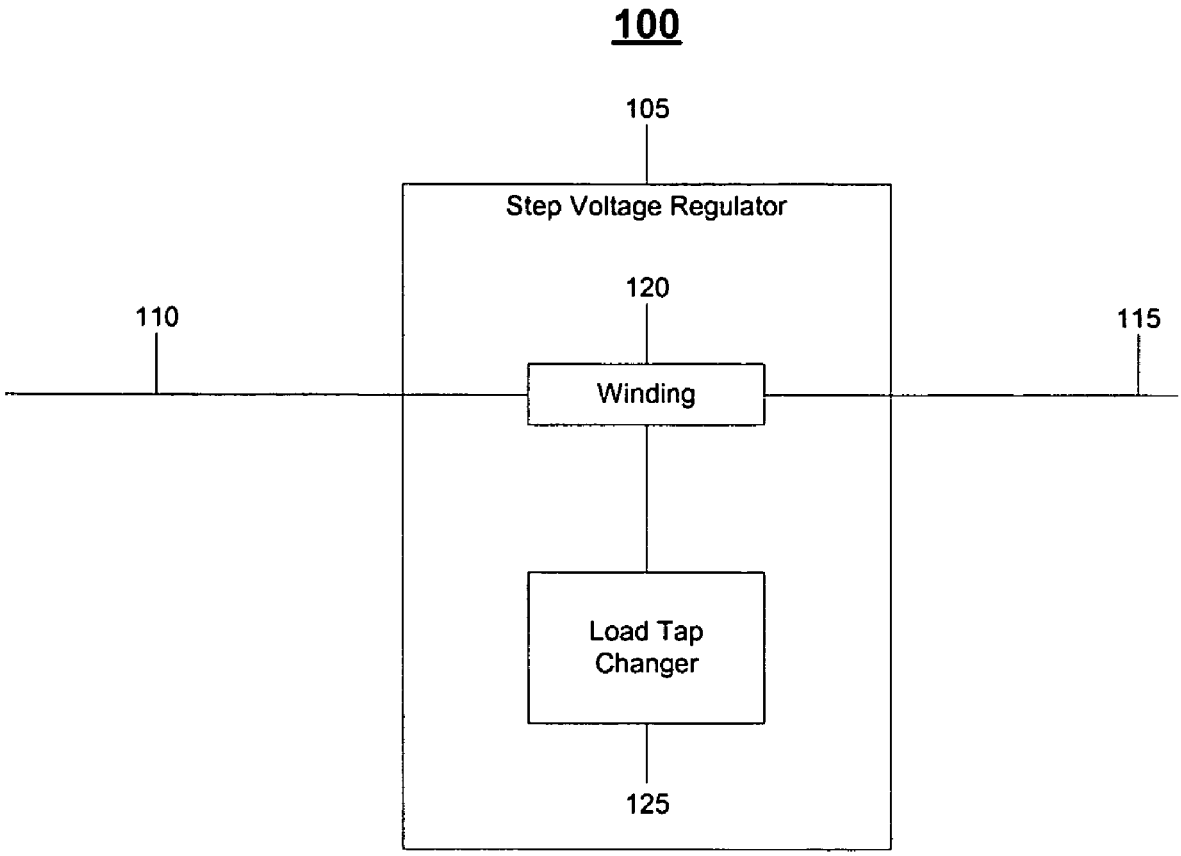
FIG. 1 is a block diagram on an electrical system that uses a load tap changer.

Referring to FIG. 1, an electric distribution system 100 includes an electrical control device 105. The electrical control device 105 transfers a voltage on an input conductor 110 to a load on an output conductor 115. The electrical control device 105 uses a winding 120 to regulate the voltage of the output conductor 115. The electrical control device 105 includes a load tap changer 125 that selectively engages different taps of a tapped section of the winding 120 to eliminate variations in the voltage on the output conductor 115.

Power is placed on the input conductor 110 by a power source, such as a hydroelectric dam or generating station. The power may reach the input conductor 110 and the electrical control device 105 after being distributed from the power source by a high voltage three-phase distribution system. The electrical control device 105 controls the voltage received from the distribution system. In some implementations, the electrical control device 105 is a transformer used to step down the distribution line voltage to a value that is acceptable for an end user. In other implementations, the electrical control device 105 is a voltage regulator that regulates a single phase of the voltage on the input conductor 110.

The winding 120 of the electrical control device 105 includes a high voltage primary winding, a secondary winding, and a magnetic core. The high voltage winding includes a wire wound in a series of wire loops around the core, the ends of which are connected to the high voltage distribution system through the input conductor 110. The secondary winding likewise includes a series of wire loops wrapped around the core. The secondary winding is connected to the ultimate local load distribution system through the output conductor 115. In implementations where the electrical control device 105 is a transformer, the secondary winding has far fewer wire loops than the primary winding. Thus, the voltage induced on the secondary winding and the output conductor 115 is far lower than the voltage on the primary winding and the input conductor 110.

Although the ratio of loops in the primary and secondary windings does not exactly match the ratio of input or primary voltage to output or secondary voltage, the correspondence is close enough to permit fine regulation of the voltage on the output conductor 115 by making slight modifications in the number of windings in the secondary winding that are electrically connected to the load. This is accomplished by placing a series of leads, or taps, in conductive engagement with the secondary winding at an evenly spaced number of windings apart. For example, if a ten percent variation is required, a tap is placed on the secondary winding at approximately ten percent of the windings from the end of the secondary winding. Further refinement within that ten percent variation may be accomplished by further subdividing the final ten percent of the windings with additional taps.

Variations in the voltage on the input conductor 110 can cause corresponding variations in the voltage on the output conductor 115. Such variations in line voltage can be detrimental to the performance and life of industrial equipment, and annoying to residential electricity users. The load tap changer 125 is used to address the voltage variations. The load tap changer 125 is a device that employs a secondary circuit voltage detector to actuate a mechanical linkage to selectively engage the taps of a tapped section of the winding 120 in response to voltage variations in order to control the voltage on the output conductor 115 while the electrical control device 105 is under load. The load tap changer 125 may be used for controlling the voltage of, for example, a single-phase voltage regulator or a three-phase transformer.

The load tap changer 125 includes one or more pairs of movable contacts. The movable contacts move among and engage different ones of a series of stationary contacts, each of which connects to a tap of the winding 120. When the movable contacts engage one or more of the stationary contacts, a tap of the winding 120 is selected, which sets the number of windings in the secondary winding and the polarity of the secondary winding, and thereby controls the voltage on the secondary winding.

Figure 2:
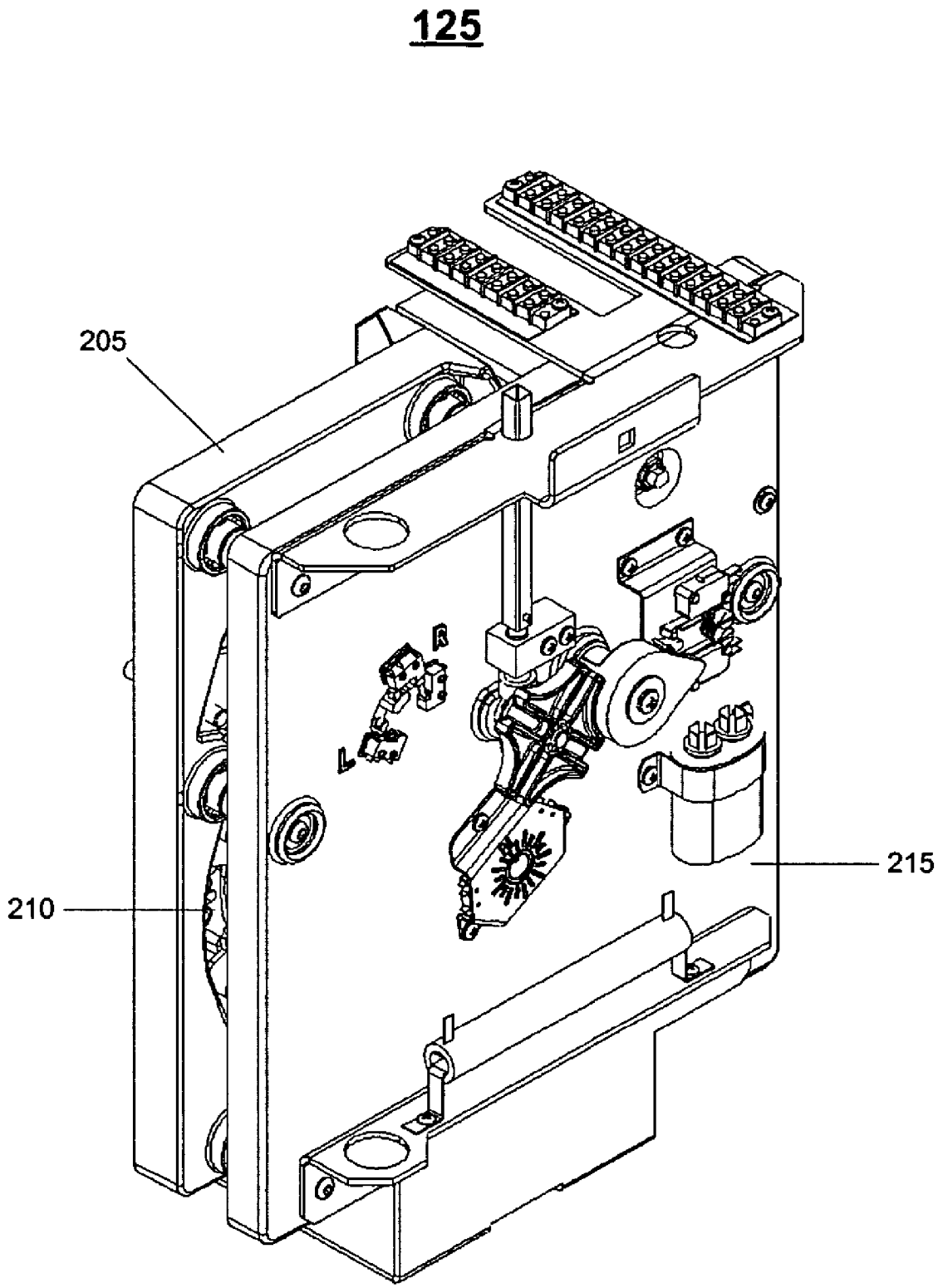
FIG. 2 is a perspective view of the load tap changer of FIG. 1.

Referring also to FIG. 2, the load tap changer 125 includes a base assembly 205, a movable assembly 210 and a cover assembly 215. The base assembly 205, the movable assembly 210, and the cover assembly 215 include molded polymer components that do not require insulation and are operable with reduced clearance relative to conductive metal components. Therefore, the base assembly 205, the movable assembly 210, and the cover assembly 215 may be placed close together to reduce the overall size of the load tap changer 125. In addition, the molded polymer components reduce the overall number, size, weight, and cost of components of the base assembly 205, the movable assembly 210 and the cover assembly 215, which facilitates manufacturing and assembling the load tap changer 125. For example, the molded polymer components do not require expensive casting or machining. Therefore, the base assembly 205 and the cover assembly 215 provide structural support to the load tap changer 125, provide dielectric insulation between components of the load tap changer 125, enable easy assembly of the load tap changer 125, and allow for proper alignment of the components of the load tap changer 125.

The base assembly 205 includes stationary contacts that connect to the taps of the winding 120. The movable assembly 210 includes two pairs of movable contacts and rotates relative to the base assembly 205 to enable each pair of the movable contacts to engage a stationary contact of the base assembly 205. The cover assembly 215 includes a drive mechanism that causes the movable assembly 210 to rotate in response to voltage variations on the input conductor 110. The drive mechanism may include an AC synchronous motor that immediately stops the motion of the movable assembly 210 when power is withdrawn. The drive mechanism may use a direct gear drive system with plastic gearing to cause rotation of the movable assembly 210. The cover assembly 215 also provides a housing for the base assembly 205 and the movable assembly 210. In addition, the cover assembly includes limit and logic switches that prevent the movable assembly 210 from rotating into mechanical stops of the load tap changer 125. The load tap changer 125 also may include a reversing assembly that engages reversing stationary contacts included in the base assembly 205 to enable voltage regulation in both the positive and negative directions.

Figure 3:
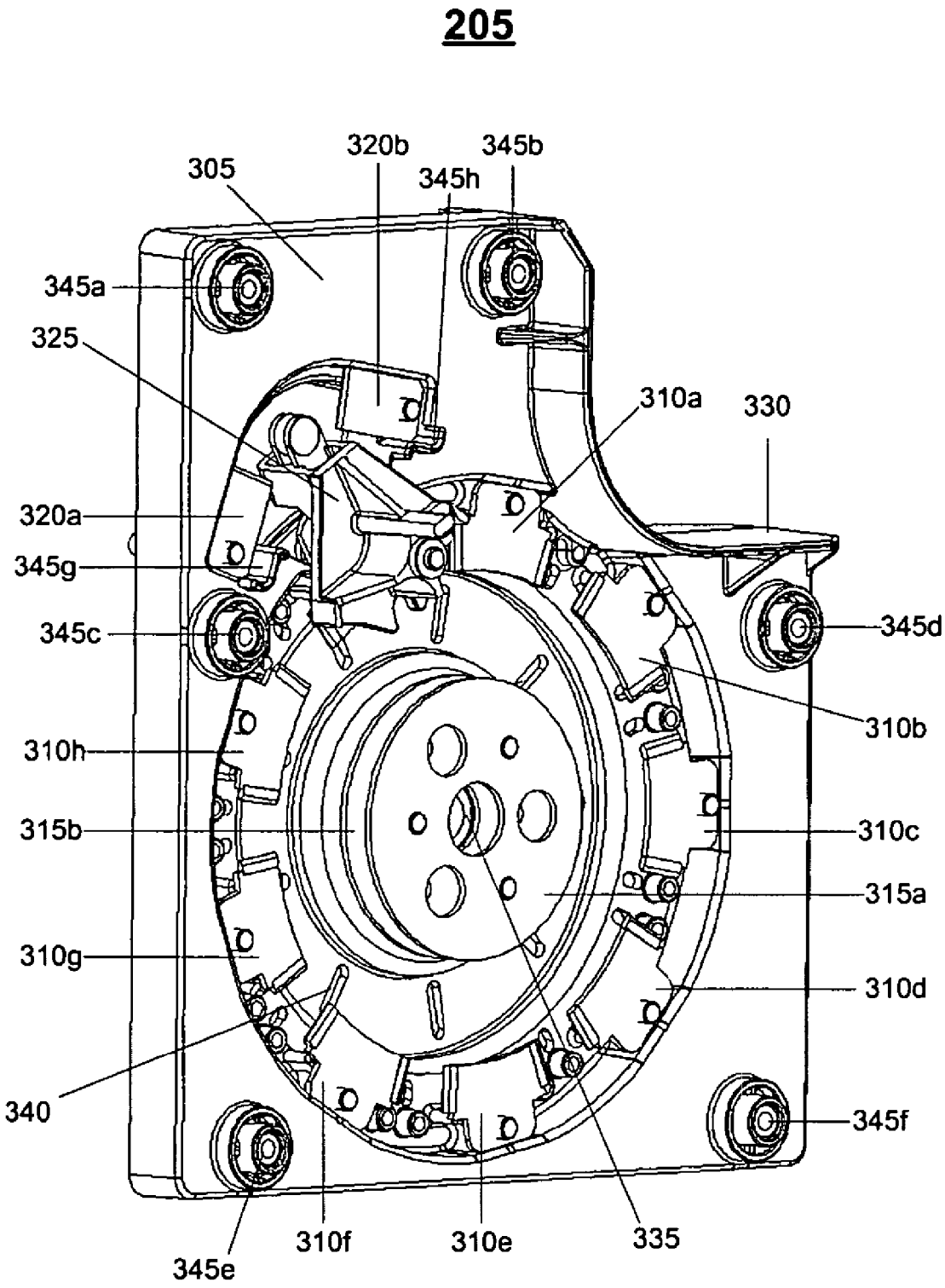
FIG. 3 is a perspective view of a base assembly of the load tap changer of FIG. 1.
Figure 4:
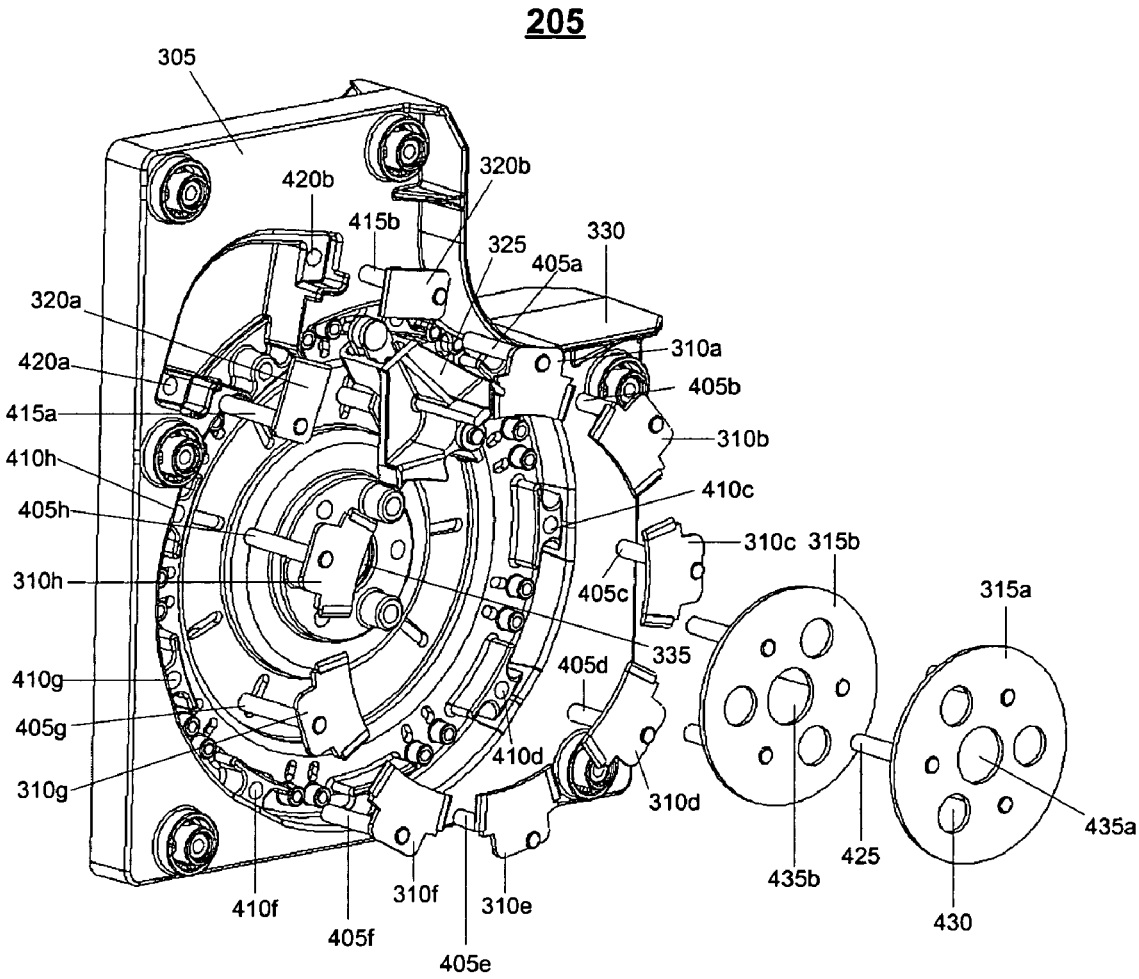
FIG. 4 is an exploded view of the base assembly of FIG. 3.

Referring to FIGS. 3 and 4, the base assembly 205 includes a base element 305 onto which multiple stationary contacts 310*a*-310*h* are mounted. Stationary contact disks 315*a* and 315*b* also are mounted on the base element 305. Two stationary reversing contacts 320*a* and 320*b* that are engaged by a reversing assembly 325 also are mounted on the base element 305. The base element 305 includes an insulating wall 330 that provides electrical clearance between the stationary contacts 310*a*-310*h* and a motor of the load tap changer 125. A hole 335 in the center of the base element 305 is configured to allow rotation of a movable assembly that carries movable contacts that engage particular ones of the stationary contacts 310*a*-310*h*. Slots in the base element 305, such as the slot 340, allow for fluids, such as oil, to flow through the base assembly 205. Electrical barriers 345*a*-345*h* that are molded into the base element 305 allow for minimal clearance between live parts and grounded support features.

The base element 305 is a single piece of molded polymer onto which other components of the base assembly 205 are mounted. The base element 305 may include molded attachment features that facilitate mounting and securing the other components to the base assembly 205. Molding the attachment features into the base element 305 reduces the need for additional fasteners to secure the other components to the base element 305, and thereby facilitates manufacture and assembly of the base assembly 205. In addition, other features of the base element 305, such as the insulating wall 330, the hole 335, the slots, and the electrical barriers 345*a*-345*h*, are molded into the base element 305. In one implementation, a plastic bushing is inserted into the hole 335 to serve as a pivot point for the movable assembly.

The stationary contacts 310*a*-310*h* are positioned on the base element 305 in a ring around the hole 335 and the stationary contact disks 315*a* and 315*b*. In particular, the stationary contacts 310*a*-310*h* are held in pockets molded into the base element 305. The molded pockets accurately position the stationary contacts 310*a*-310*h* and prevent the stationary contacts 310*a*-310*h* from rotating as a result of interaction with the movable contacts of the movable assembly. Furthermore, the molded pockets hold the stationary contacts 310*a*-310*h* in the same plane.

As shown in FIG. 4, the stationary contacts 310*a*-310*h* are connected to conducting rods 405*a*-405*h*, respectively. More particularly, each of the stationary contacts 310*a*-310*h* is connected to one of the conducting rods 405*a*-405*h* such that the plane of the stationary contacts 310*a*-310*h* is perpendicular to the longitudinal axes of the conducting rods 405*a*-405*h*. Therefore, when the stationary contacts 310*a*-310*h* are mounted flatly in the molded pockets of the base element 305, the conducting rods 405*a*-405*h* extend through the base element 305. More particularly, the conducting rods 405*a*-405*h* extend through holes 410*a*-410*h* in each of the molded pockets such that the conducting rods 405*a*-405*h* are visible on an opposite side of the base element. In one implementation, the conducting rods 405*a*-405*h* are threaded, and nuts and washers are used to attach the conducting rods 405*a*-405*h* and the corresponding stationary contacts 310*a*-310*h* to the base element 305 on the opposite side of the base element 305. The nuts and washers may be made out of brass.

The conducting rods 405*a*-405*h* are used to connect the stationary contacts 310*a*-310*h* to taps of a winding of an electrical control device that employs the load tap changer that includes the base assembly 205. Each of the conducting rods 405*a*-405*h* connects to one of the taps in the winding such that the stationary contacts 310*a*-310*h* are connected to the taps of the winding through the conducting rods 405*a*-405*h*. In one implementation, the stationary contacts 310*a*-

310*h* have tungsten-composite leading edges that prevent damage to the stationary contacts 310*a*-310*h* during arcing and thereby extend the life of the stationary contacts 310*a*-310*h*.

The stationary contact disks 315*a* and 315*b* are mounted in the center of the base element 305. The stationary contact disks 315*a* and 315*b* may be made of bare copper or plated copper, such as nickel-plated copper. Each of the stationary contact disks 315*a* and 315*b* is perpendicularly connected to one or more conducting rods, such as a conducting rod 425. The conducting rods connected to the stationary contact disks 315*a* and 315*b* extend through and are attached to the base element 305 in a similar manner as the conducting rods 405*a*-405*h*. In particular, the conducting rods are attached to the base element 305 such that the corresponding stationary contact disks 315*a* and 315*b* are in the same planes as the movable contacts of the movable assembly. The contact rods of the stationary contact disks 315*a* and 315*b*, and consequently the stationary contact disks 315*a* and 315*b* themselves, connect to a bridging reactor of the load tap changer.

The stationary contact disk 315*a* is placed over the stationary contact disk 315*b*. In order to enable the conducting rods of the stationary contact disk 315*a* to pass through to the opposite side of the base element 305, the stationary contact disks 315*a* and 315*b* include a series of holes through which the conducting rods may pass. Therefore, the conducting rods of the stationary contact disk 315*a* pass through the holes in the stationary contact disk 315*b*, such as a hole 430. In addition, the stationary contact disks 315*a* and 315*b* include central holes 435*a* and 435*b* that allow the movable assembly to access the hole 335 after the stationary contact disks 315*a* and 315*b* have been secured to the base element 305.

In one implementation, the conducting rods connected to the stationary contact disk 315*a* fit into bosses molded into the base element 305 to allow for space between the stationary contact disks 315*a* and 315*b* and for proper connection to movable contacts of the load tap changer. In another implementation, the conducting rods connected to the stationary contact disk 315*a* are longer than conducting rods connected to the stationary contact disk 315*b* to allow for space between the stationary contact disks 315*a* and 315*b* and for proper connection to movable contacts of the load tap changer.

The stationary reversing contacts 320*a* and 320*b*, are engaged by movable contacts in the reversing assembly 325. A neutral stationary contact that is included in the reversing assembly 325 is similarly engaged. Like the stationary contacts 310*a*-310*h*, the stationary reversing contacts 320*a* and 320*b* fit into molded pockets on the base element 305 that hold the stationary reversing contacts 320*a* and 320*b* in place. The stationary reversing contacts 320*a* and 320*b* are perpendicularly connected to conducting rods 415*a* and 415*b*, respectively. The conducting rods 415*a* and 415*b* extend through the base element 305 through holes 420*a* and 420*b*, respectively. In one implementation, the conducting rods 415*a* and 415*b* are threaded and are attached to the base element 305 with nuts and washers that may be made of brass. Each of the conducting rods 415*a* and 415*b* connects to one of the two end taps of the winding. Therefore, the stationary reversing contacts 320*a* and 320*b* are connected to the end taps of the winding through the conducting rods 415*a* and 415*h*.

Figure 5:
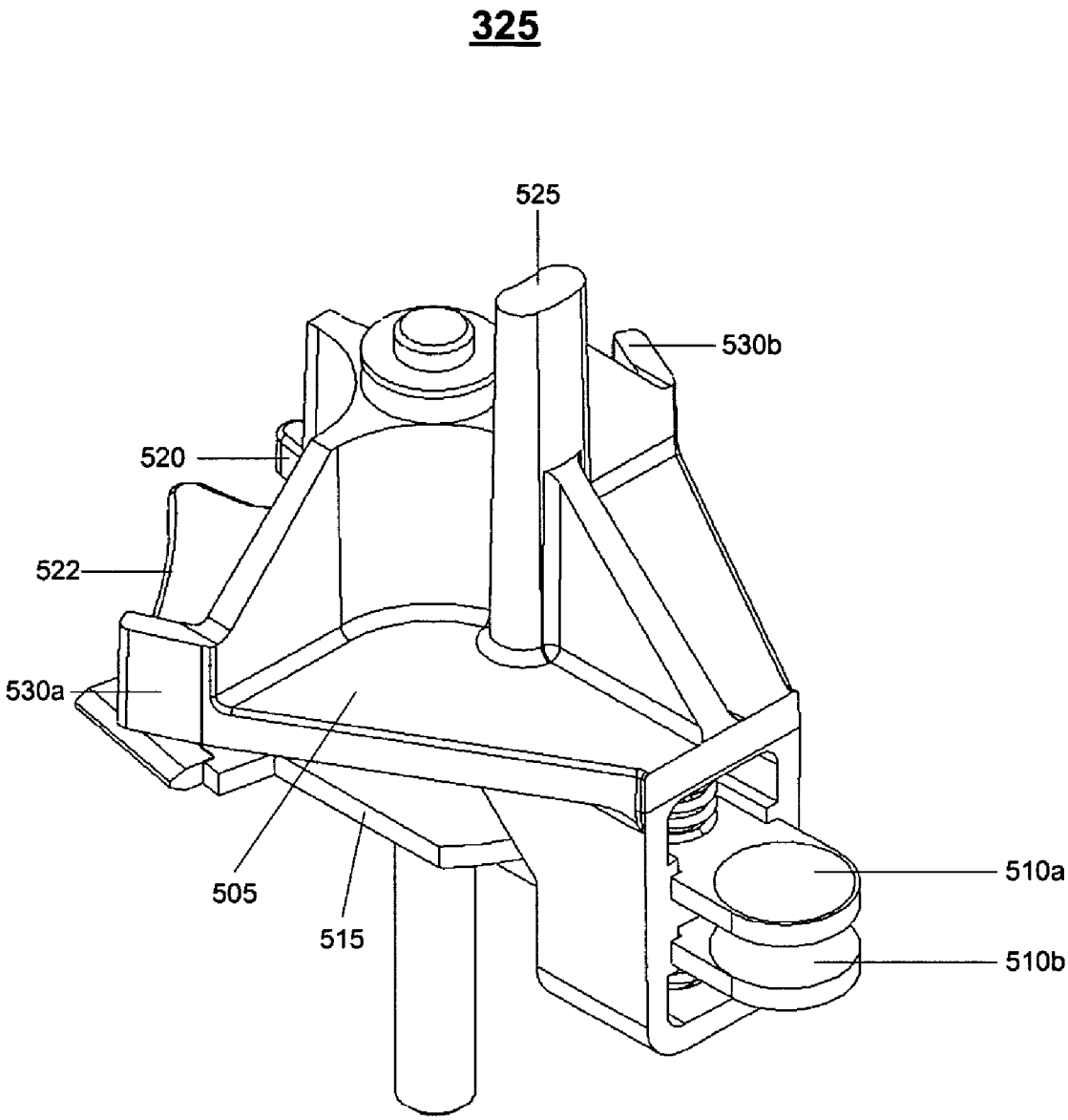
FIG. 5 is a perspective view of a reversing assembly of the load tap changer of FIG. 1.
Figure 6:
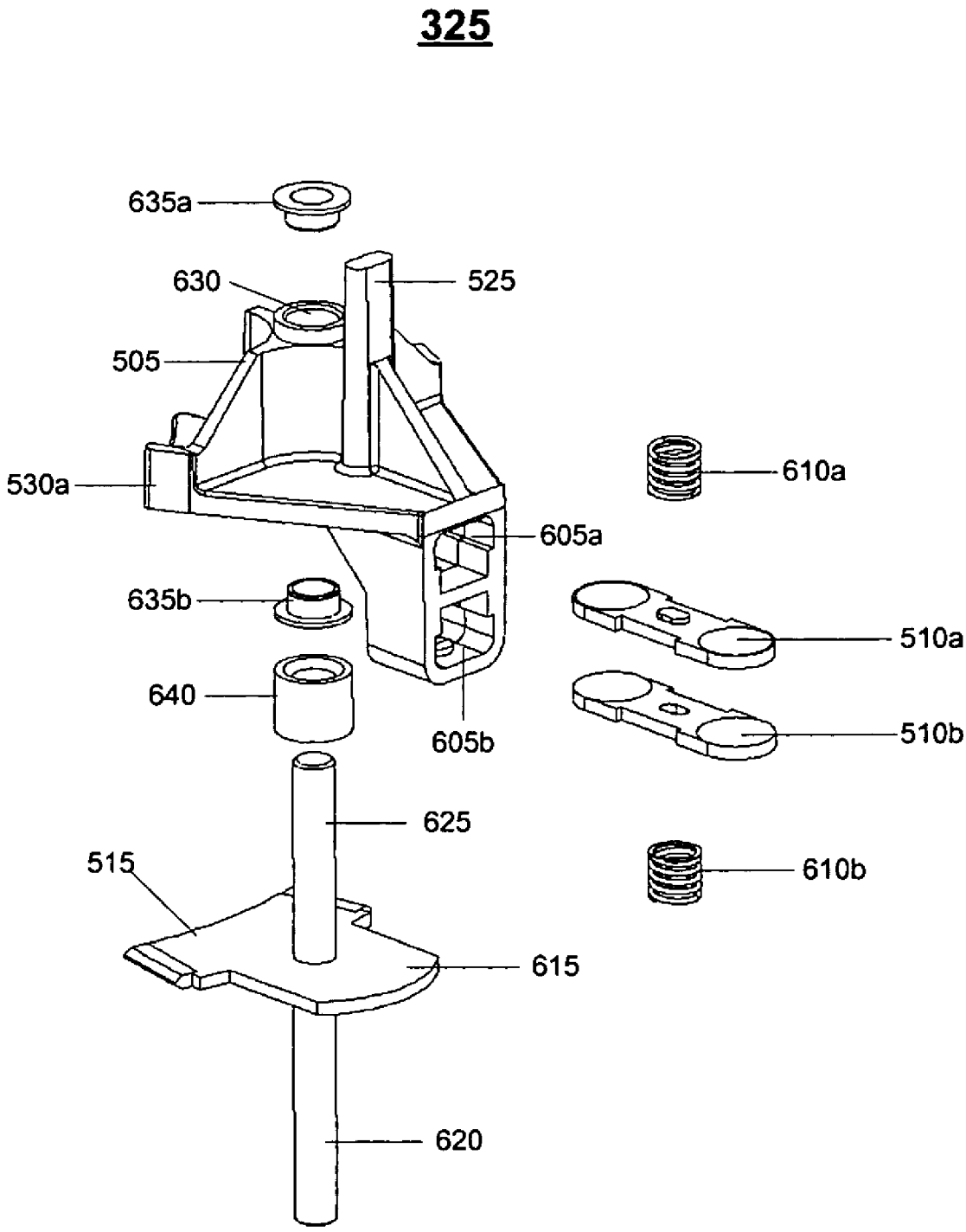
FIG. 6 is an exploded view of the reversing assembly of FIG. 5.

Referring also to FIGS. 5 and 6, the reversing assembly 325 includes a reversing element 505 onto which movable reversing contacts 510*a* and 510*b* are mounted. The reversing assembly 325 also includes a neutral stationary contact assembly 515 that includes a neutral stationary contact. The reversing element 505 includes a reversing arm 520 that is engaged to move the reversing assembly 325, a protrusion 525 that indicates the position of the reversing assembly 325, and stops 530*a* and 530*b* that limit rotation of the movable assembly.

The reversing element 505 is a single piece of polymer onto which other components of the reversing assembly 325 are mounted. The reversing element 505 may include molded attachment features that facilitate mounting and securing of the other components to the reversing assembly 325. Molding the attachment features into the reversing element 505 reduces the need for additional fasteners to secure the other components to the reversing element 505, thereby facilitating manufacture and assembly of the reversing assembly 325. In addition, other features of the reversing element 505 are molded into the reversing element 505. For example, the reversing arm 520, the protrusion 525, and the stops 530*a* and 530*b* are features that are molded into the reversing element 505.

The movable reversing contacts 510*a* and 510*b* are mounted into contact pockets 605*a* and 605*b* that are molded into the reversing element 505. The movable reversing contacts 510*a* and 510*b* extend through the contact pockets 605*a* and 605*b* such that both sides of the movable reversing contacts 510*a* and 510*b* may engage other contacts. Notches in the movable reversing contacts 510*a* and 510*b* mate with side walls of the contact pockets 605*a* and 605*b* to hold the movable reversing contacts 510*a* and 510*b* in the contact pockets 605*a* and 605*b* and to prevent the movable reversing contacts 510*a* and 510*b* from sliding within the contact pockets 605*a* and 605*b*. Compression springs 610*a* and 610*b*, which provide a force between the movable reversing contacts 510*a* and 510*b* and the stationary reversing contacts 320*a* and 320*b* are mounted in the contact pockets 605*a* and 605*b*. This force is sufficient for maintaining an electrical connection between the movable reversing contacts 510*a* and 510*b* and the stationary reversing contacts 320*a* and 320*b*. In addition, the compression springs 610*a* and 610*b* allow the movable reversing contacts 510*a* and 510*b* to move up and down for proper alignment with the stationary reversing contacts 320*a* and 320*b*. The movable reversing contacts 510*a* and 510*b* and the contact pockets 605*a* and 605*b* include spring retention features that hold the compression springs 610*a* and 610*b* in the contact pockets 605*a* and 605*b*.

The neutral stationary contact assembly 515 is similar to the stationary contacts 310*a*-310*h*. The neutral stationary contact assembly includes a neutral stationary contact 615, a conducting rod 620, and a mounting pole 625. The neutral stationary contact 615 is located in another molded pocked of the base element 305 under the reversing assembly 325. The neutral stationary contact 615 may be engaged by the movable reversing contacts 510*a* and 510*b*, as well as by movable contacts of the movable assembly.

The neutral stationary contact 615 is perpendicularly connected to the conducting rod 620. The conducting rod 620 extends through the base element 305 and, in certain implementations, is attached to the base element 305 by a nut and a washer. The neutral stationary contact 615 is connected to a neutral tap in the winding through the conducting rod 620.

The reversing element 505 is mounted on the mounting pole 625, which serves as a pivot point for the reversing element 505. The reversing element 505 includes hole 630 into which the mounting pole is inserted. Plastic bushings 635*a* and 635*b* may be placed over the ends of the hole 630 to facilitate rotation of the reversing element 505 about the mounting pole 625. In some implementations, a spacing element 640 is placed onto the mounting pole 625 before the reversing element 505 to maintain a particular distance between the neutral stationary contact 615 and the reversing element 505. For example, the spacing element 640 may maintain a distance between the neutral stationary contact 615 and the reversing element 505 that enables the movable reversing contacts 510*a* and 510*b* to engage the neutral stationary contact 615 and the stationary reversing contacts 320*a* and 320*b*.

The reversing arm 520 is engaged by a corresponding feature of the movable assembly as the movable contacts move past the reversing assembly 325. As a result, the reversing element 505 and the reversing assembly 325 as a whole are moved when the movable contacts move past the reversing assembly 325. The relative shapes of the reversing element 505 and the movable assembly allow the movable assembly to cause the reversing element 325 to rotate only when the movable contacts are moving through a neutral position. More particularly, the reversing arm 520 is only engaged when the movable contacts are moving through the neutral position. For example, curved edges of the reversing element 505, such as a curved edge 522, match the outer circumference of the movable assembly such that the movable assembly rotates past the reversing assembly, except when the movable contacts are moving through the neutral position, at which point a feature of the movable assembly engages the reversing arm 520.

In certain implementations, the protrusion 525 indicates the position of the reversing assembly 325 and moves with the reversing element 505 and the reversing assembly 325. The protrusion 525 also may activate logic switches that prevent the movable assembly from rotating into the stops 530*a* and 530*b* at the end of the tap change sequences. If the movable assembly does rotate into the stops 530*a* and 530*b*, the stops 530*a* and 530*b* prevent further rotation of the movable assembly. The movable assembly encounters the stops 530*a* and 530*b* when the movable assembly has rotated into a maximum or minimum allowable position. Thus, the stops 530*a* and 530*b* prevent the movable assembly from rotating past the maximum or minimum allowable positions.

The reversing assembly 325 generally moves between three positions. In one position, the movable contacts 510*a* and 510*b* bridge the neutral stationary contact 615 and the stationary reversing contact 320*a*, in which case, one of the end taps of the winding is selected. In another position, the movable contacts 510*a*-510*b* bridge the neutral stationary contact 615 and the stationary reversing contact 320*b*, in which case, the other end tap of the winding is selected. In a third position, the movable contacts 510*a* and 510*b* do not engage either of the stationary reversing contacts 320*a* and 320*b*, in which case a neutral tap of the winding is selected. The polarity of the winding depends on which of the end taps and the neutral tap are engaged. An amount by which an output voltage of the electric control device is adjusted may be controlled to be positive or negative based on the position of the reversing assembly and the resulting polarity of the winding.

The movable reversing contact 510*a* engages the stationary reversing contacts 320*a* and 320*b* and the neutral stationary contact 615 on an upper side of the contacts 320*a*, 320*b*, and 615. By contrast, the movable reversing contact 510*b* engages the contacts 320*a*, 320*b* and 615 on a lower side of the contacts. In other words, the contacts 320*a*, 320*b* and 615 fit between the movable reversing contacts 510*a* and 510*b*.

The electrical barriers 345*a*-345*f* molded in the base element 305 each mate with a corresponding electrical barrier molded into the cover assembly. The pairs of electrical barriers insulate from other live components bolts that are used to connect the base assembly 205 to the cover assembly. The electrical barriers 345*g* and 345*h* insulate the stationary reversing contacts 320*a* and 320*b* from the other live components of the base assembly 205.

The holes 410*a*-410*h*, 420*a* and 420*b*, the hole through which the conducting rod of the neutral stationary contact 615 extends through the base element 305, and the holes through which conducting rods of the stationary contact disks 315*a* and 315*b* extend through the base element 305 may be labeled with an indication of the coil and bushing leads to which the corresponding conducting rods connect. For example, the indications may be molded into the opposite side of the base element 305 for identification purposes during assembly or repair.

Figure 7A:
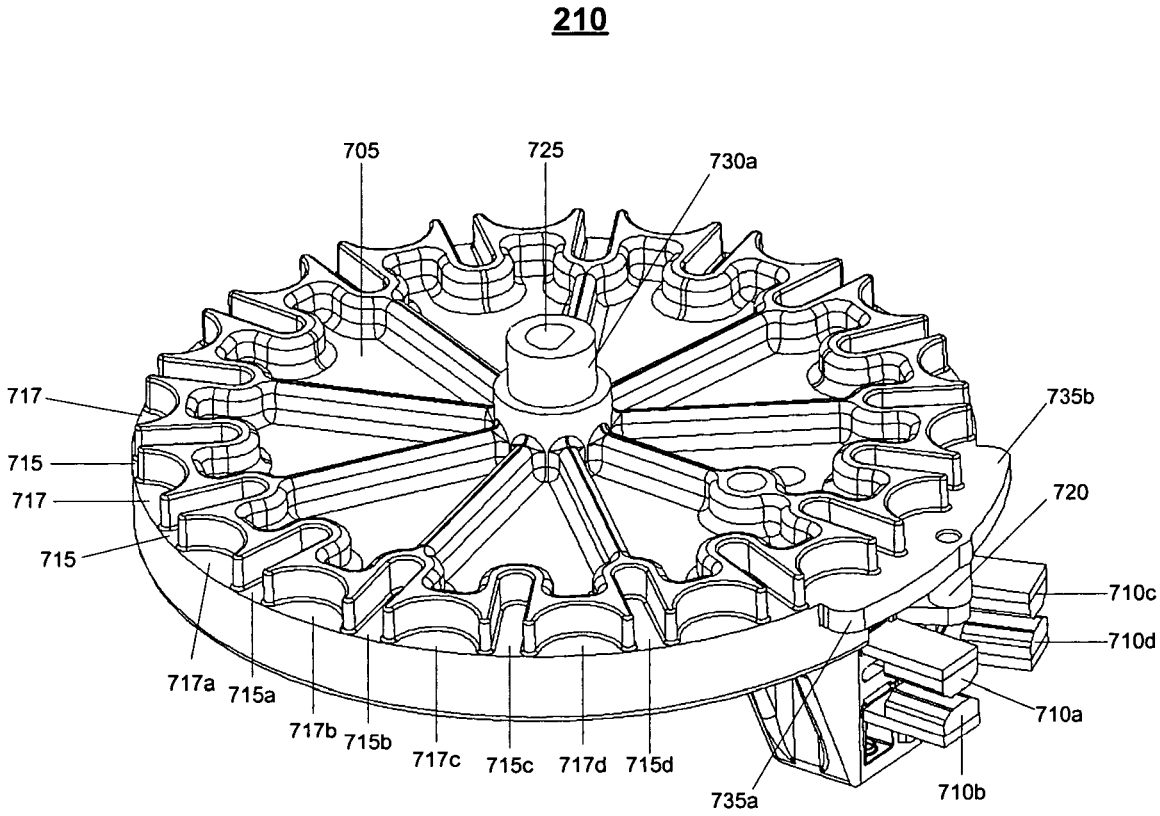
FIG. 7A is a top perspective view of a movable assembly of the load tap changer of FIG. 1.
Figure 7B:
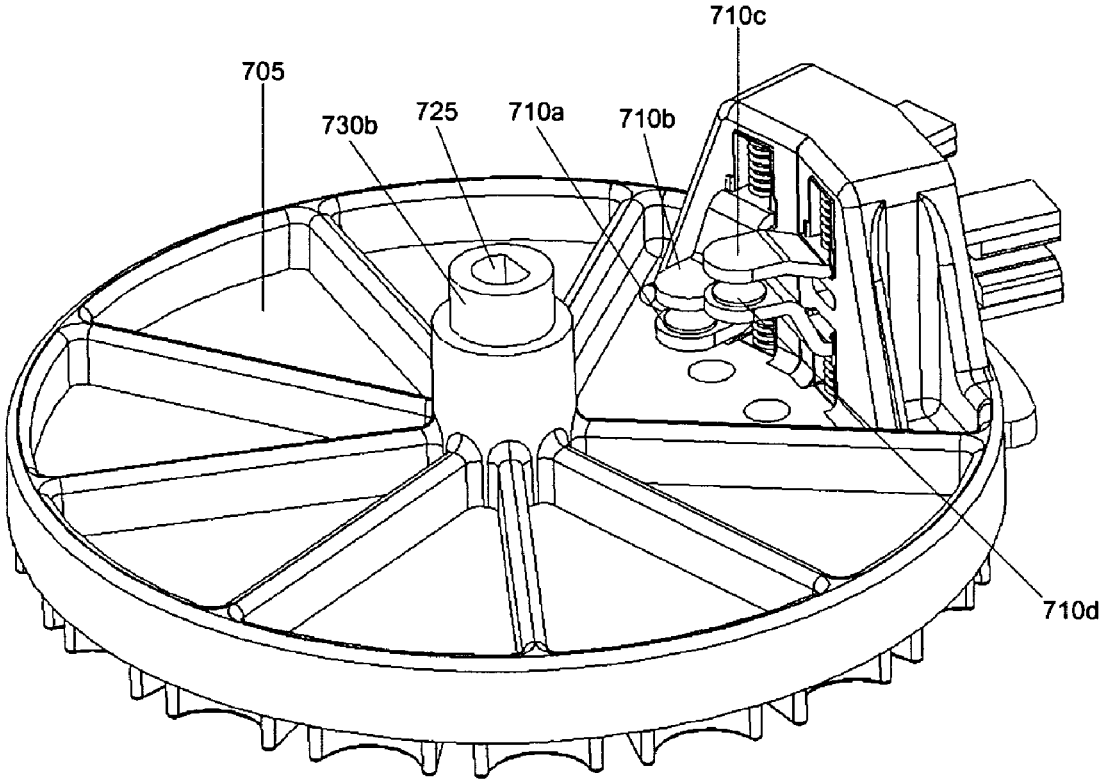
FIG. 7B is a bottom perspective view of the movable assembly of FIG. 7A.
Figure 8:
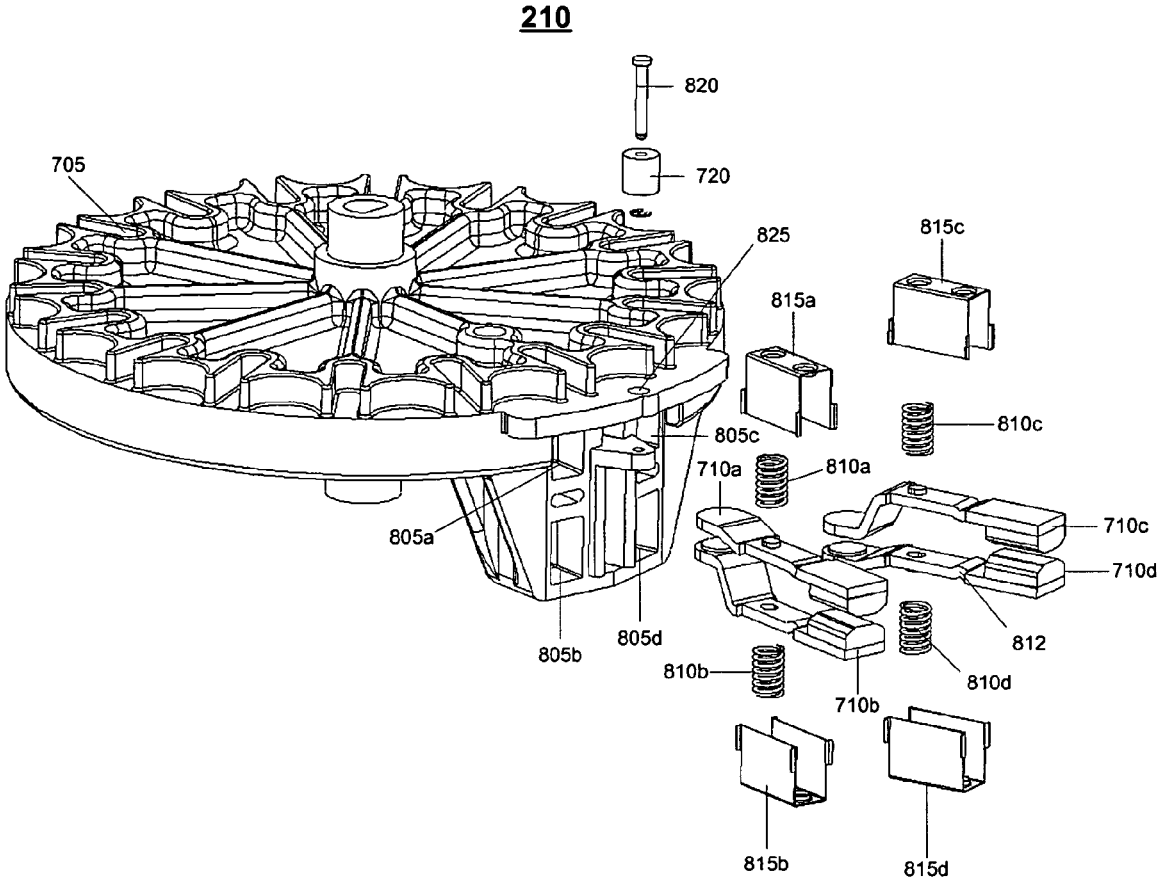
FIG. 8 is an exploded view of the movable assembly of FIGS. 7A and 7B.
Figure 9A:
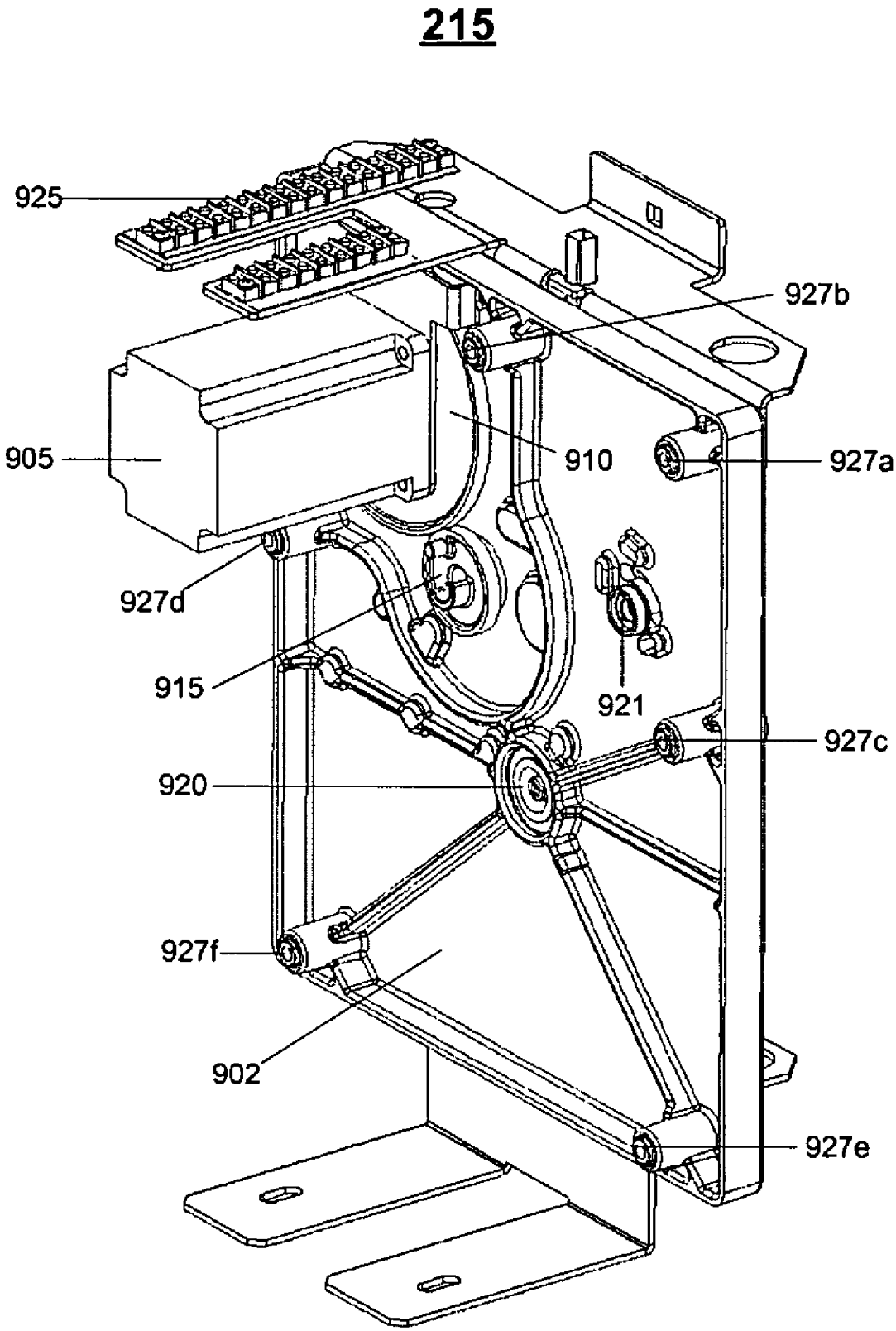
FIG. 9A is a back perspective view of a cover assembly of the load tap changer of FIG. 1.
Figure 9B:
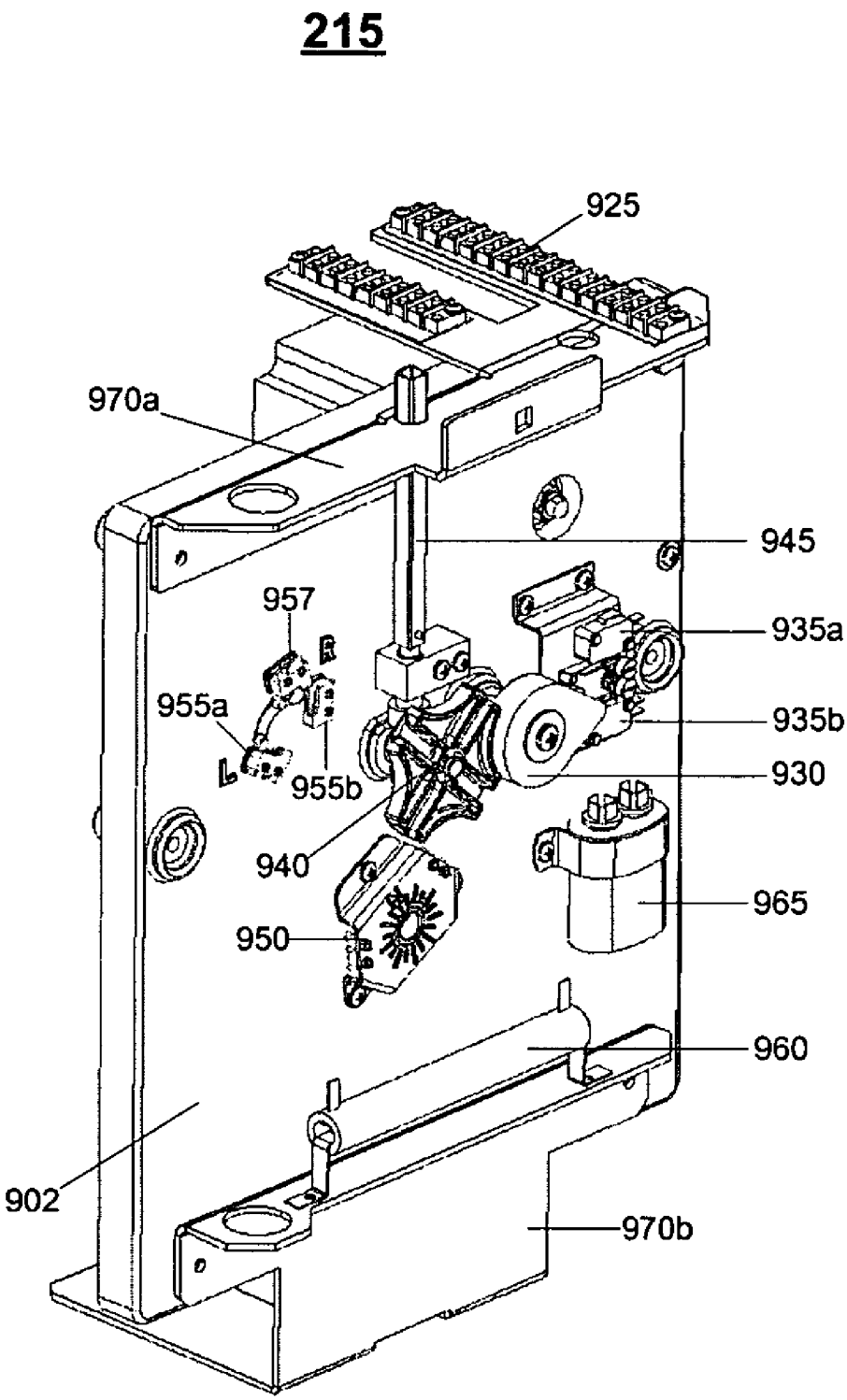
FIG. 9B is a front perspective view of the cover assembly of FIG. 9A.
Figure 10A:
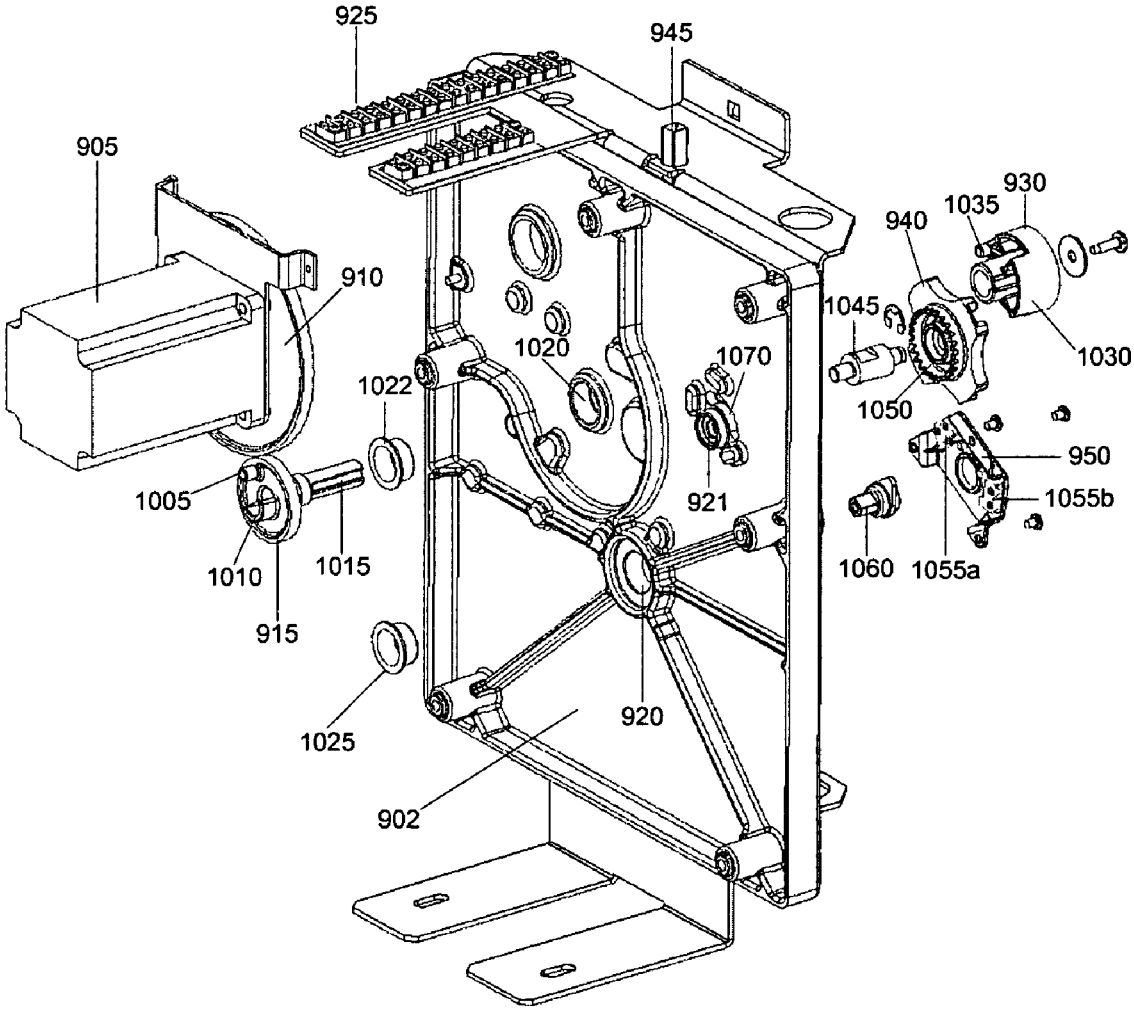
FIG. 10A is an exploded back perspective view of the cover assembly of FIGS. 9A and 9B.
Figure 10B:
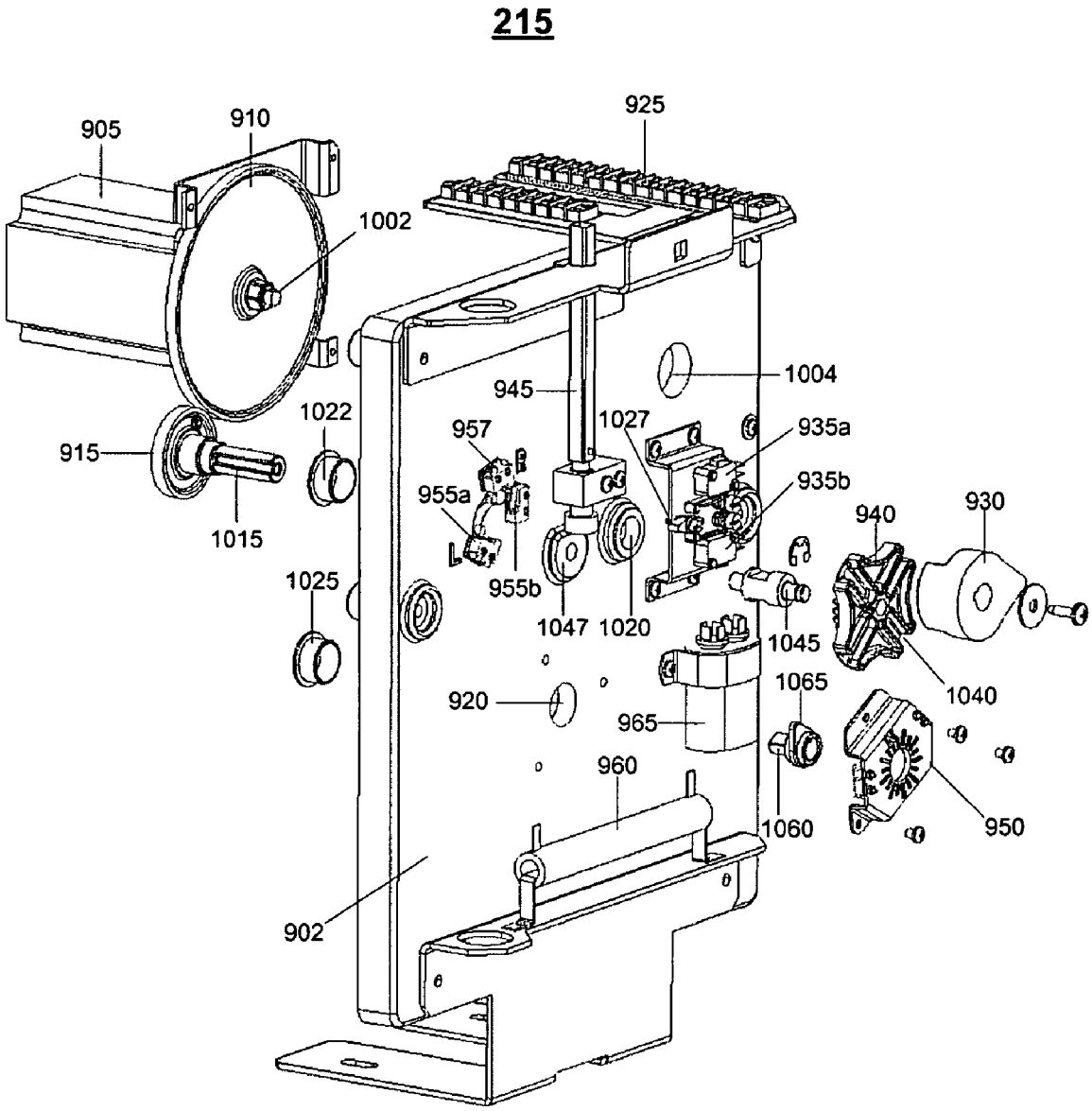
FIG. 10B is an exploded front perspective view of the cover assembly of FIGS. 9A and 9B.

Referring to FIGS. 7A, 7B, and 8, a movable assembly 210 of a load tap changer includes a movable element 705 onto which movable contacts 710*a*-710*d* are mounted. The movable assembly 210 also includes Geneva gear slots 715 (including slots 715*a*-715*d*) that are engaged to cause rotation of the movable assembly 210, and locking slots 717 (including locking slots 717*a*-717*d*) that are engaged to prevent rotation of the movable assembly 210. In addition, the movable assembly 210 includes a plastic roller bearing 720 that engages the reversing assembly 325 shown in FIGS. 3-6, and a slot 725 into which a component that is to rotate with the movable assembly 210 may be placed. The movable assembly 210 also includes pivot points 730*a* and 730*b* about which the movable assembly 210 rotates and stop features 735*a* and 735*b* that limit the rotation of the movable assembly 210 past maximum and minimum allowable positions.

The movable element 705 is a single piece of molded polymer onto which other components of the movable assembly 210 are mounted. The movable element 705 may include molded attachment features that facilitate mounting and securing the other components to the movable assembly 210. Molding the attachment features into the movable element 705 reduces the need for additional fasteners to secure the other components to the movable element 705, and thereby facilitates manufacture and assembly of the movable assembly 210. In addition, other features of the movable element 705, such as the Geneva gear slots 715, the locking slots 717, the slot 725, the pivot points 730*a* and 730*b*, and the stop features 735*a* and 735*b*, are molded into the movable element 705.

Like the movable reversing contacts 510*a* and 510*b* of FIGS. 5 and 6, the movable contacts 710*a*-710*d* are mounted into contact pockets 805*a*-805*d* that are molded into the movable element 705. The movable contacts 710*a*-710*d* extend through the contact pockets 805*a*-805*d* such that one side of the movable contacts 710*a*-710*d* may engage the stationary contacts 310*a*-310*h* of FIGS. 3 and 4 and the other side of the movable contacts 710*a*-710*d* may engage the stationary contact disks 315*a* and 315*b* of FIGS. 3 and 4. Notches in the movable contacts 710*a*-710*d* mate with side walls of the contact pockets 805*a*-805*d* to hold the movable contacts 710*a*-710*d* in the contact pockets 805*a*-805*d* and to prevent the movable contacts 710*a*-710*d* from sliding within the contact pockets 805*a*-805*d*. Compression springs 810*a*-810*d* are mounted inside the contact pockets 805*a*-805*d*. The compression springs 810*a*-810*d* provide a force between the movable contacts 710*a*-710*d* and the stationary contacts 310*a*-310*h* that is sufficient for maintaining an electrical connection between the movable contacts 710*a*-710*d* and the stationary contacts 310*a*-310*h*. In addition, the compression springs 810*a*-810*d* allow the movable contacts 710*a*-710*d* to move up and down for proper alignment with the stationary contacts 310*a*-310*h*. More particularly, the movable contacts 710*a*-710*d* each include a pivot, such as the pivot 812 of the movable contact 710*d*, on which the movable contacts 710*a*-710*d* rock within the contact pockets 805*a*-805*d* to properly align with the stationary contacts 310*a*-310*h*. The compression springs 810*a*-810*d* are located further within the contact pockets 805*a*-805*d* than the pivots of the movable contacts 710*a*-710*d*.

Contact wearplates 815*a*-815*d* are placed within the contact pockets 805*a*-805*d* and around the movable contacts 710*a*-710*d* and the compression springs 810*a*-810*d*. The contact wearplates 815*a*-815*d* prevent the movable contacts 710*a*-710*d* from wearing down the inner surfaces of the contact pockets 805*a*-805*d* as the movable contacts engage the stationary contacts 310*a*-310*h*. In addition, the contact wearplates 815*a*-815*d* include spring retention features that provide attachment points for the compression springs 810*a*-810*d*. Similarly, the movable contacts 710*a*-710*d* include spring retention features for the compression springs 810*a*-810*d*. In one implementation, the contact wearplates 815*a*-815*d* are made of spring steel.

The movable contacts 710*a*-710*d* bridge between the stationary contacts 310*a*-310*h* and the stationary contact disks 315*a* and 315*b*. Alternatively, when the movable assembly 210 is in a certain orientation, the movable contacts 710*a*-710*d* bridge between the neutral stationary contact 615 of FIG. 6 and the stationary contact disks 315*a* and 315*b*. The movable contacts 710*a*-710*d* are always engaged with the stationary contact disks 315*a* and 315*b* at one end of the movable contacts 710*a*-710*d*. The movable contacts 710*a*-710*d* move to engage one or two of the stationary contacts 310*a*-310*h* and 615 on an opposite end of the movable contacts 710*a*-710*d*. Ends of the movable contacts 710*a*-710*d* include protective tips that collectively limit the wear on the movable contacts 710*a*-710*d*. For example, the movable contacts 710*a*-710*d* may be worn as a result of sliding on the stationary contact disks 315*a* and 315*b*. In addition, the movable contacts may be worn as a result of arcing, which occurs when the movable contacts 710*a*-710*d* move between the stationary contacts 310*a*-310*h* and 615. In addition, the tips enable the movable contacts 710*a*-710*d* to rock and maintain consistent pressure on the stationary contact disks 315*a* and 315*b* and on the stationary contacts 310*a*-310*h* and 615, which prevents undesirable arcing, especially between the movable contacts 710*a*-710*d* and the stationary contact disks 315*a* and 315*b*. In one implementation, the protective tips are made of a tungsten copper composite. In such an implementation, parts the movable contacts 710*a*-710*d* separate from the protective tips have single-piece, solid copper cross sections.

The movable contacts 710*a*-710*d* are arranged in two pairs. More particularly, the movable contacts 710*a* and 710*b* form one pair and the movable contacts 710*c* and 710*d* form another pair. One of each pair of the movable contacts 710*a*-710*d* engages upper sides of the stationary contacts 310*a*-310*h* and 615 and the stationary contact disks 315*a* and 315*b*. The other of each pair of contacts engages lower sides of the stationary contacts 310*a*-310*h* and 615 and the stationary contact disks 315*a* and 315*b*. In other words, the stationary contacts 310*a*-310*h* and 615 and the stationary contact disks 315*a* and 315*b* fit between the two movable contacts of each of the pairs of the movable contacts 710*a*-710*d*. One of the pairs of movable contacts engages the stationary contact disk 315*a*, while the other pair engages the stationary contact disk 315*b*.

Both of the pairs of movable contacts 710*a*-710*d* may be engaged with one of the stationary contacts 310*a*-310*h* and 615, or each pair may be engaged with one of two adjacent stationary contacts 310*a*-310*h* and 615. One of the pairs of movable contacts engages the stationary contact disk 315*a*, while the other pair engages the stationary contact disk 315*b*. The stationary contact disks 315*a* and 315*b* connect to opposite ends of a bridging reactor. When the movable contacts 710*a*-710*d* engage two of the stationary contacts 310*a*-310*h* and 615, the bridging reactor limits the resultant current circulating through the movable contacts 710*a*-710*d* and the stationary contact disks 315*a* and 315*b*. This, in turn, permits finer voltage regulation.

The pivots of the movable contacts 710*a*-710*d* and the relative locations of the compression springs 810*a*-810*d* maintain a small distance between the pairs of the movable contacts 710*a*-710*d*, which prevents the pairs of the movable contacts 710*a*-710*d* from coming together after disengaging one of the stationary contacts 310*a*-310*h* and 615. Additionally, maintaining the distance reduces the torque required for the movable contacts to engage the stationary contacts 310*a*-310*h* and 615. Furthermore, the pivots prevent the movable contacts 710*a*-710*d* from bouncing off of the stationary contacts 310*a*-310*h* and 615, either one time or repeatedly, as the stationary contacts 310*a*-310*h* and 615 are engaged, which may result in undesirable arcing.

Alternating Geneva gear slots 715 and locking slots 717 are placed around the perimeter of the movable assembly 210. The Geneva gear slots 715 and the locking slots 717 are molded into a top side of the movable element 705. One of the Geneva gear slots 715 and one of the locking slots 717 mate with features of a Geneva drive gear mounted on a cover assembly of the load tap changer on each full rotation of the Geneva drive gear. The Geneva drive gear is rotated in response to variations in the voltage on an output conductor of the electric control device. Rotation of the Geneva drive gear may cause a corresponding rotation in the movable assembly 210. More particularly, a pin on the Geneva drive gear engages the Geneva gear slots 715. As the Geneva drive gear rotates, the pin causes the Geneva gear slots 715, and, consequently, the entire movable assembly 210, to rotate. Eventually, the pin becomes disengaged and a locking feature on the Geneva drive gear mates with the locking slots 717. The locking feature prevents further rotation of the movable assembly 210. In addition, the locking feature aligns the movable assembly 210 such that the movable contacts 710*a*-710*d* are properly aligned with the stationary contacts 310*a*-310*h* and 615. The locking feature also aligns the movable assembly such that the pin on the Geneva drive gear may engage an adjacent one of the Geneva gear slots 715 on the next full rotation of the Geneva drive gear.

In one implementation, the Geneva drive gear completes one full rotation in response to a voltage variation, which causes a corresponding rotation in the movable assembly 210. For example, rotating the Geneva drive gear 360° may cause the movable assembly 210 to rotate 200. The stationary contacts 310*a*-310*h* are sufficiently sized and spaced such that rotating the movable assembly 210 in response to a full rotation of the Geneva drive gear causes the movable contacts 710*a*-710*d* to engage a different set of the stationary contacts 310*a*-310*h* and 615. Therefore, in response to a detected voltage variation, a different tap is selected to handle the voltage variation.

The plastic roller bearing 720 is located between the movable contacts 710*a*-710*d*. The plastic roller bearing engages the reversing assembly 325 of FIGS. 3-6 as the movable contacts 710*a*-710*d* move past the reversing assembly 325. More particularly, the plastic roller bearing 720 engages the reversing arm 520 of FIGS. 5 and 6 to cause rotation in the reversing assembly 325. The plastic roller bearing 720 is held in place and rotates about a pin 820 that fits through a hole 825 in the movable assembly. Allowing the plastic roller bearing 720 to rotate prolongs the life of the plastic roller bearing 720.

In one implementation, an indicator cam is placed in the slot 725. An indicator arrow that identifies the tap that has been selected as a result of the current position of the movable assembly 210 may be molded onto the indicator cam. The indicator cam also may engage limit switches that prevent the movable assembly 210 from rotating into mechanical stops at the end of tap change sequences.

The pivot points 730*a* and 730*b* are molded into the center of the movable element 705 to provide points about which the movable assembly 210 rotates. More particularly, the pivot point 730*b* mates with the hole 335 of FIGS. 3 and 4. In implementations where a plastic bushing is inserted into the hole 335, the pivot point 730*b* mates with the plastic bushing. Similarly, the pivot point 730*a* mates with a hole in the cover assembly or with a plastic bushing within the hole in the cover assembly. Once mated, the pivot points 730*a* and 730*b* facilitate rotation of the movable element 705 and the movable contacts 710*a*-710*d* in the corresponding holes or plastic bushings.

The stop features 735*a* and 735*b* limit the rotation of the movable assembly 210. More particularly, when the movable assembly 210 has rotated into a maximum or minimum allowable position, one of the stop features 735*a* or 735*b* encounters one of the stops of the reversing assembly 325, such as one of the stops 530*a* and 530*b* of FIG. 5. The encountered stop prevents the movable assembly 210 from rotating past the maximum or the minimum allowable position by pressing against the corresponding stop feature 735*a* or 735*b* of the movable assembly.

Referring to FIGS. 9A, 9B, 10A, and 10B, a cover assembly 215 of a load tap changer includes a cover element 902 onto which a motor 905 has been mounted. The motor 905 drives a motor gear 910 that in turn drives a Geneva drive gear 915. The cover assembly 215 also includes a hole 920 about which the movable assembly 210 of FIGS. 7A and 7B rotates, a stabilization feature 921 about which the reversing assembly 325 of FIGS. 5 and 6 rotates, and a terminal block 925 that is used for input wiring. Electrical barriers 927*a*-927*f* molded into the cover element 902 allow for minimal clearance between live parts and grounded support features. A position indicator (PI) cam 930 activates holding switches 935*a* and 935*b*. The PI cam 930 also drives a PI Geneva gear 940 and a PI tube 945 mounted on the cover element 902 and connected to a PI that indicates which tap is currently selected by the load tap changer. A limit switch module 950, logic switches 955*a* and 955*b*, and a neutral indicating switch 957 also are mounted on the cover element 902. A resistor 960 and a capacitor 965 ensure proper operation of the motor 905. Mounting brackets 970*a* and 970*b* are used to attach the load tap changer to an electrical control device that uses the load tap changer.

The cover element 902 is a single piece of molded polymer onto which other components of the cover assembly 215 are mounted. The cover element 902 may include molded attachment features that facilitate mounting and securing the other components to the cover assembly 215. Molding the attachment features into the cover element 902 reduces the need for additional fasteners to secure the other components to the cover element 902, thereby facilitating manufacture and assembly of the cover assembly 215. In addition, other features of the cover element 902, such as the hole 920, the stabilization feature 921, and the electrical barriers 927*a*-927*f*, are molded into the cover element 902.

The motor 905 is the source of motion of the load tap changer. Rotation of the motor 905 drives motion of other components of the load tap changer. In one implementation, the motor 905 is an AC synchronous motor. In such an implementation, the motor 905 stops rotating as soon as the motor 905 is de-energized. Therefore, an external braking mechanism is not required to stop the motor 905 and other moving components of the load tap changer once the motor 905 is de-energized. In one implementation, the motor turns at 72 revolutions per minute (RPM). The motor 905 is configured to receive a signal from a control apparatus of the electrical control device that uses the load tap changer. The control apparatus sends the motor 905 the signal when a deviation in the voltage on an output of the electrical control device from a desired voltage is detected. The signal indicates whether the voltage on the output is higher or lower than the desired voltage. The motor 905 uses the signal to determine the direction in which to rotate. Because the motor is constructed of metal, the motor 905 is located at the furthest point in the load tap changer from other high-voltage components of the load tap changer. Furthermore, the motor 905 is insulated from the rest of the load tap changer by an insulating wall, such as the insulating wall 330 of FIG. 3.

The motor 905 is coupled to the motor gear 910. In some implementations, the motor gear 910 is made of a plastic. The motor gear may include a hex feature 1002 that may be used to manually rotate the motor gear 910. The hex feature 1002 may be accessed through a hole 1004 in the cover element 902. The hex feature 1002 may be used to manually rotate the motor gear 910, for example, when the motor 905 is unable to rotate the motor gear 910 due to failure or power loss, or in other instances when a change in tap position is needed.

The motor gear 910 directly drives the Geneva drive gear 915, which is also made of plastic. Therefore, a chain is not needed to rotate the Geneva drive gear in response to the rotation of the motor 905. In one implementation, one full rotation of the motor gear 910 causes approximately 2.8 full rotations of the Geneva drive gear 915. The Geneva drive gear 915 includes a pin 1005 that extends perpendicularly out from the Geneva drive gear 915. When the load tap changer is assembled, the pin 1005 extends towards the movable assembly of the load tap changer. The pin 1005 engages Geneva gear slots, such as the Geneva gear slots 715*a*-715*d* of FIGS. 7A and 7B. More particularly, as the Geneva drive gear 915 rotates, the pin 1005 enters one of the Geneva gear slots and pushes against a side of the entered Geneva gear slot, thereby causing the movable assembly to rotate. As the Geneva drive gear 915 rotates further, the pin 1005 exits the entered Geneva gear slot and the movable assembly stops rotating. In some implementations, the pin 1005 includes a hardened steel pin and a hardened steel roller fastened to the Geneva drive gear 915. The hardened steel roller rotates about the hardened steel pin as the pin 1005 engages the Geneva gear slots. The hardened steel roller and pin serve to prolong the life of the pin 1005.

The Geneva drive gear 915 also includes a locking feature 1010 that mates with locking slots on the movable assembly, such as the locking slots 717*a*-717*d* of FIGS. 7A and 7B. As the pin 1005 exits a Geneva gear slot, the locking feature 1010 enters an adjacent locking slot. The locking feature 1010 has a similar shape as the locking slots. When the locking feature 1010 enters one of the locking slots, the similar shapes of the locking feature 1010 and the entered locking slot align. When the locking feature 1010 and the locking slot are aligned, the movable assembly is held in a proper orientation for movable contacts of the movable assembly to engage stationary contacts in a base assembly of the load tap changer, and also for the pin 1005 to enter an adjacent Geneva gear slot. In addition, when the locking feature 1010 and the entered locking slot are aligned, the movable assembly is prevented from rotating further. As the Geneva drive gear 915 continues to rotate, the locking feature 1010 exits the entered locking slot, and the pin 1005 enters a new Geneva gear slot.

A plastic shaft 1015 is molded into or mounted on an opposite side of the Geneva drive gear 915 from the pin 1005 and the locking feature 1010. The shaft 1015 rotates as the Geneva drive gear 915 rotates. The shaft 1015 extends through the cover element 902 through a hole 1020 in the cover element 902. In one implementation, a plastic bushing 1022 is placed in the hole 1020 to facilitate rotation of the shaft 1015 within the hole.

The hole 920 extends through the center of the cover element 902 and is configured to allow rotation of the movable assembly. More particularly, a pivot point of the movable assembly, such as the pivot point 730*a* of FIG. 7A, fits into the hole 920 such that the movable assembly may rotate about the pivot point in the hole 920. In some implementations, a plastic bushing 1025 is inserted into the hole 920 to facilitate rotation of the movable assembly about the pivot point in the hole. The stabilization feature 921 stabilizes the reversing assembly such that the reversing assembly may rotate properly between stationary reversing contacts. The stabilization feature 921 mates with the plastic bushing 635*b* of FIG. 6 to stabilize the reversing assembly as the reversing assembly rotates.

The terminal block 925 is used for electrically connecting the control apparatus of the electrical control device to the load tap changer and to connect the motor 905 to the control apparatus from which signals for tap change operations are received. The electrical barriers 927*a*-927*f* each mate with electrical barriers on the base assembly, such as the electrical barriers 345*a*-345*f* of FIG. 3, to insulate bolts used to connect the base assembly to the cover assembly 215 from other live components.

The PI cam 930 is connected to the shaft 1015 on an opposite side of the cover element 902 from the Geneva gear 915. The PI cam 930 is a plastic component that rotates in the same direction as the Geneva drive gear 915. The shaft 1015 has molded features that mate with corresponding features on the PI cam 930 that allows the PI cam 930 to rotate with the Geneva drive gear 915 without slippage. Rotation of the PI cam 930 engages a holding switch lever 1027 that activates and de-activates the holding switches 935*a* and 935*b*. The holding switches 935*a* and 935*b*, when activated, keep the motor 905 energized and, when deactivated, allow the motor to be de-energized. Therefore, the holding switches 935*a* and 935*b* are activated during a tap change operation and de-activated otherwise. The PI cam 930 includes a holding wall 1030 that is taller than the rest of the wall of the PI cam 930. The holding wall 1030 is tall enough to encounter the holding switch lever 1027 while the rest of the wall is not. As the PI cam 930 rotates, the holding wall 1030 engages the holding switch lever 1027, which, in turn, activates the holding switches 935*a* and 935*b*. The holding switches 935*a* and 935*b*, in turn, cause the motor to remain activated as long as the holding wall 1030 is engaging and moving past the holding switch lever 1027. When shorter sections of the wall of the PI cam 930 move past the holding switch lever 1027, the holding switch lever 1027 is not engaged, the holding switches 935*a* and 935*b* are released and deactivated, and the motor 905 is allowed to de-energize.

The PI cam 930 also engages the PI Geneva gear 940, which also may be made of plastic. More particularly, the PI cam 930 includes a pin 1035 that enters and exits slots, such as the slot 1040, that are molded into the PI Geneva gear 940. In one implementation, the PI Geneva gear 940 includes four equally spaced slots. The pin 1035 enters and exits one of the slots on each full revolution of the PI cam 930. Therefore, in the above implementation, each full revolution of the PI cam 930 results in a 90° revolution of the PI Geneva gear 940. The PI Geneva gear 940 rotates on a steel PI Geneva gear shaft 1045. One end of the PI Geneva gear shaft 1045 may be placed in a threaded insert 1047 molded into the cover element 902, while the PI Geneva gear 940 fits over an opposite end of the PI Geneva gear shaft 1045.

A gear 1050 is molded into an opposite side of the PI Geneva gear 940 from the slots of the PI Geneva gear 940. The gear 1050 is used to cause rotation in the PI tube 945. The gear 1050 mates with a corresponding gear on the PI tube 945 to translate the rotation of the PI Geneva gear 940 to the PI tube 945. In the above implementation, the PI tube 945 rotates 180° for every 90° of rotation in the PI Geneva gear 940. Therefore, the PI tube 945 rotates 180° for every full rotation of the PI cam 930. The PI tube 945 rotates a cable assembly that moves a dial indicator in a PI for the load tap changer. The dial indicator of the PI is an external indicator of the tap that has been selected by the load tap changer.

The limit switch module 950 that is mounted to the cover element 902 includes limit switches 1055*a* and 1055*b* that are activated when the movable assembly moves into maximum allowable positions to prevent the movable assembly from hitting mechanical stops of the load tap changer. When activated, the limit switches 1055*a* and 1055*b* cause the motor 905 to be de-energized, which prevents further rotation of the movable assembly. The limit switch module 950 also includes an indicator cam 1060 that activates the limit switches 1055*a* and 1055*b*. The indicator cam 1060 fits into a slot in the movable assembly, such as the slot 725 of FIG. 7A, and extends through the cover assembly through the hole 920 molded into the cover element 902. The indicator cam 1060 rotates with the movable assembly and is oriented in the slot in the movable assembly such that the indicator cam 1060 activates the limit switches 1055*a* and 1055*b* when the movable assembly is in one of the maximum allowable positions. In some implementations, the limit switch assembly 950 includes a dial that includes the possible taps that may be selected with the load tap changer, and the indicator cam 1060 includes an indicator arrow 1065 that indicates the currently selected tap on the dial. As the indicator cam 1060 rotates with the movable assembly, the indicator arrow 1065 moves to indicate the currently selected tap on the dial.

The logic switches 955*a* and 955*b* work with the limit switches 1055*a* and 1055*b* to prevent the movable assembly from rotating past the maximum allowable positions. The logic switches 955*a* and 955*b* are activated by a protrusion of a reversing assembly of the load tap changer, such as the protrusion 525 of FIG. 5. The protrusion extends through the cover assembly 215 through a hole 1070 in the cover element 902 to a side of the cover element 902 on which the logic switches 955*a* and 955*b* are mounted. One of the logic switches 955*a* and 955*b* is activated when movable contacts of the reversing assembly engage a stationary reversing contact, such as one of the stationary reversing contacts 320*a* and 320*b* of FIG. 3. For example, the logic switch 955*a* is activated when the stationary reversing contact 320*a* is engaged, and the logic switch 955*b* is activated when the stationary reversing contact 320*b* is engaged.

Therefore, the location of the protrusion within the hole 1070 is indicative of the stationary reversing contact 320*a* or 320*b* that is engaged. The hole 1070 may be labeled to identify which of the stationary reversing contacts 320*a* and 320*b* is engaged based on the position of the protrusion within the hole 1070. In one implementation, an "R" and an "L" are molded into the cover element 902 near the hole 1070 to indicate whether the stationary reversing contact corresponding to a raising tap position or the stationary reversing contact corresponding to a lowering tap positing is engaged.

The logic switches 955*a* and 955*b* indicate the direction in which the voltage on the output of the electrical control device is corrected to restore the voltage to the desired value. When the logic switches 955*a* and 955*b* indicate that the output voltage is being raised and the limit switches 1055*a* and 1055*b* indicate that the movable assembly is in the maximum allowable raising position, the motor 905 is de-energized. Similarly, the motor 905 is de-energized when the logic switches 955*a* and 955*b* indicate that the output voltage is being lowered and the limit switches 1055*a* and 1055*b* indicate that the movable assembly is in the maximum allowable lowering position.

In addition, the protrusion of the reversing assembly activates the neutral indicating switch 957 when the movable contacts of the reversing assembly are not engaged with the stationary reversing contacts. In one implementation, the neutral indicating switch 957 drives a lamp that is lit when the stationary reversing contacts are not engaged by the movable contacts of the reversing assembly. When the neutral indicating switch 957 is activated, there is no deviation in the voltage on the output of the electrical control device from the desired voltage.

The resistor 960 and the capacitor 965 may be mounted to the cover element 902 and are electrically connected to the motor 905. The resistor 960 and the capacitor 965 are necessary for proper operation of the motor 905. For example, without the resistor 960 and the capacitor 965, the motor 905 would not be able to begin to rotate in response to the signal received from the control apparatus of the electrical control device. In one implementation, the resistor 960 and the capacitor 965 are mounted to the cover element 902 with metal brackets. In another implementation, the capacitor 965 is mounted in a case that houses the control apparatus of the electrical control device.

The metal mounting brackets 970*a* and 970*b* are used to attach the load tap changer to the electrical control device. In addition, the terminal block is mounted to the upper mounting bracket 970*a*. The upper mounting bracket 970*a* also reinforces the connection between the motor and the motor 905 and the cover element 902 and guides wire and coil leads past the load tap changer. The lower mounting bracket 970*b* also guides the coil leads past the tap changer and provides a location for the resistor 960 to be mounted.

Figure 11:
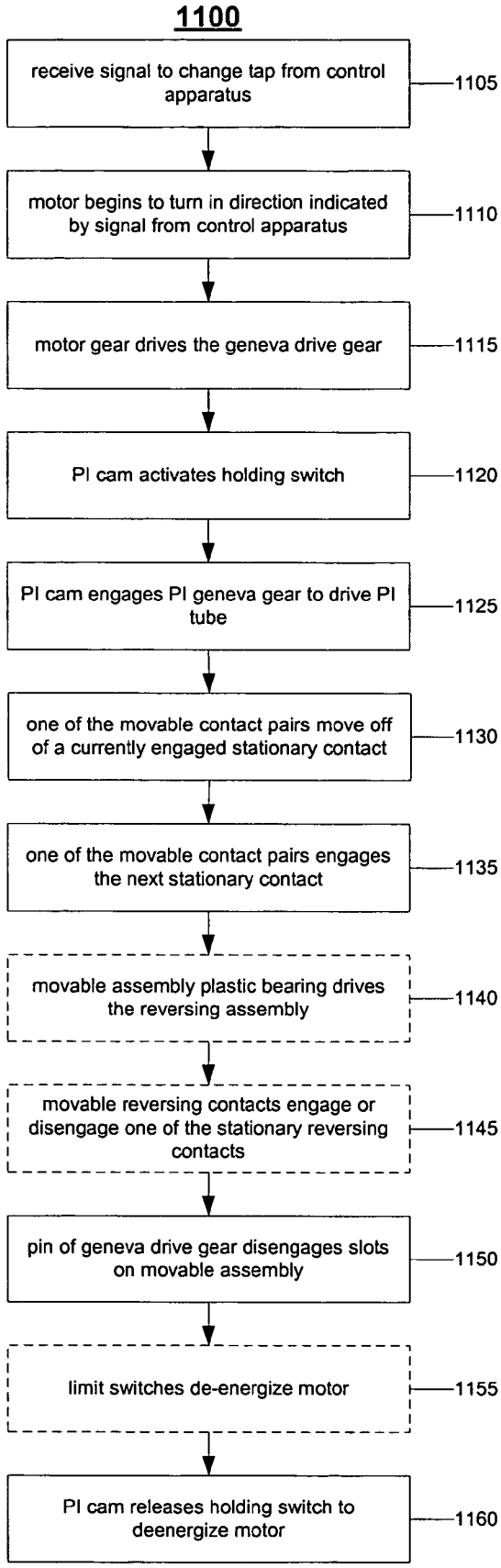
FIG. 11 is a flow chart of a process implemented by the load tap changer of FIG. 1.

Referring to FIG. 11, a process 1100 is implemented by the load tap changer 125 of FIG. 1. The load tap changer 125 executes the process 1100 to select a different tap of a winding in an electrical control device 105 that uses the load tap changer 125 in response to a voltage variation detected by the electrical control device. Execution of the process 1100 keeps the voltage on the output conductor 115 of the electrical control device 105 substantially constant even though the voltage on the input conductor 110 of the electrical control device 105 may be changing.

A control apparatus of the electrical control device 105 detects a variation from a desired voltage on the output conductor 115 of the electrical control device 105. More particularly, the control apparatus detects if the voltage on the output conductor 115 is higher or lower than the desired voltage. If so, the control apparatus sends a signal to the motor 905 of the load tap changer 125 that indicates that a different tap is to be selected to restore the voltage on the output conductor 115 to the desired voltage, and the motor 905 receives the signal (step 1105). The signal indicates whether the detected voltage on the output conductor 115 is higher or lower than the desired voltage. The motor 905 begins to turn in a direction indicated by the signal from the control apparatus (step 1110). Turning the motor 905 in one direction reduces the output voltage, and turning the motor 905 in an opposite direction increases the output voltage. Therefore, if the signal indicates that the output voltage is too high, then the motor 905 begins to turn in the direction that reduces the output voltage. Similarly, if the signal indicates that the output voltage is too low, then the motor 905 begins to turn in the direction that raises the output voltage.

Rotation of the motor 905 causes a corresponding rotation in the motor gear 910, which, in turn, drives the Geneva drive gear 915 (step 1115). The Geneva drive gear 915 is attached to the PI cam 930, and rotation of the Geneva drive gear 915 causes the PI cam 930 to activate one of the holding switches 935*a* or 935*b* of the load tap changer 125 (step 1120). More particularly, the holding wall 1030 of the PI cam 930 engages the holding switch lever 1027, which activates one of the holding switches 935*a* or 935*b* and keeps one of the holding switches 935*a* or 935*b* in an activated state. When the control apparatus detects that one of the holding switches 935*a* or 935*b* has been activated, the control apparatus stops sending the signal to the motor 905. The motor 905 remains energized as long as one of the holding switches 935*a* or 935*b* is activated. The pin 1035 of the PI cam 930 also engages the PI Geneva gear 940, which, in turn, drives the PI tube 945 (step 1125). Rotation of the PI tube 945 causes a corresponding change in a position indicated by a PI for the load tap changer 125 as a result of the currently occurring tap change operation.

Before the tap change operation started, each of the two pairs of movable contacts 710*a*-710*d* may have engaged some of the stationary contacts 310*a*-310*h* and 615. Each pair may engage different stationary contacts or the same stationary contact. A rotation in the Geneva drive gear 915 causes a corresponding rotation in the movable assembly 210. More particularly, the pin 1005 of the Geneva drive gear 915 engages the Geneva gear slots 715, such as one of the slots 715*a*-715*d*, on the movable assembly 210 to cause the movable assembly 210 to rotate. As a result of the rotation of the movable assembly 210, one of the movable contact pairs moves off of the stationary contact with which the pair was previously engaged (step 1130). At this point, one of the movable contact pairs is engaged with a stationary contact, and one of the movable contact pairs is not. However, because one of the holding switches 935*a* or 935*b* is still activated, the motor 905 continues to drive the Geneva drive gear 915, which, in turn, drives the movable assembly 210. Therefore, the movable contacts continue to rotate until the movable contact pair that moved off of a stationary contact engages the next stationary contact (step 1135). At this point, both pairs of the movable contacts 710*a*-710*d* are engaged with either one or two adjacent stationary contacts.

In addition, the plastic bearing 720 of the movable assembly 210 may drive the reversing assembly 325 as the movable contacts 710*a*-710*d* move past the reversing assembly 325 (step 1140). More particularly, the bearing 720 engages the arm 520 on the reversing assembly 325 to cause the reversing assembly 325 to rotate. The movable reversing contacts 510*a* and 510*b* may disengage or engage the stationary reversing contacts 320*a* and 320*b* as a result of the rotation caused by the bearing 720 (step 1145). For example, if the movable reversing contacts 510*a* and 510*b* were engaged with one of the stationary reversing contacts 320*a* and 320*b*, the rotation may cause the movable reversing contacts 510*a* and 510*b* to disengage from the reversing stationary contacts. Similarly, if the movable reversing contacts 510*a* and 510*b* were not engaged with one of the stationary reversing contacts 320*a* and 320*b*, the rotation may cause the movable reversing contacts 510*a* and 510*b* to engage one of the stationary reversing contacts 320*a* and 320*b*.

The pin 1005 of the Geneva drive gear 915 becomes disengaged from the Geneva gear slots 715 in the movable assembly 210, which ceases rotation of the movable assembly 210 (step 1150). As the pin 1005 exits the slots 715*a*-715*d*, the locking feature 1010 on the Geneva drive gear 915 engages a locking slot 717, such as one of the locking slots 717*a*-717*d*, on the movable assembly 210. When the locking feature 1010 is engaged with a locking slot 717, the movable assembly 210 is held in a proper orientation for subsequent engagement with the pin 1005 of the Geneva drive gear 915 and with the stationary contacts 310*a*-310*h* and 615.

The logic switches 955*a* and 955*b* and the limit switches 1055*a* and 1055*b* may be activated as a result of the rotations of the movable assembly 210 and the reversing assembly 325. The logic switches 955*a* and 955*b* and the limit switches 1055*a* and 1055*b* may de-energize the motor 905 if the movable assembly 210 has reached a maximum allowable position (step 1155). The logic switches 955*a* and 955*b* and the limit switches 1055*a* and 1055*b* de-energize the motor 905 to prevent the movable assembly 210 from hitting mechanical stops in the load tap changer 125. If the motor 905 has not been de-energized by the logic switches 955*a* and 955*b* and the limit switches 1055*a* and 1055*b*, the PI cam 930 continues to rotate until the holding switches 935*a* and 935*b* are released, which de-energizes the motor 905 (step 1160). More particularly, the holding wall 1030 of the PI cam 930 moves away from and disengages the holding switch lever 1027, thereby releasing the holding switches 935*a* and 935*b*. Once the motor 905 has been de-energized, motion within the load tap changer 125 stops, and a new tap has been selected. In one implementation, the load tap changer 125 takes approximately 350 milliseconds to execute the process 1100.

It will be understood that various modifications may be made. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A load tap changer connected to a power source to control voltage supplied from the power source to a load, the load tap changer comprising:

a base assembly that includes a base element onto which multiple stationary contacts that connect to taps of a winding of an electrical control device are mounted;

a movable assembly that includes a movable element that rotates to connect at least one pair of movable contacts mounted on the movable element to a stationary contact to select a corresponding tap; and a cover assembly that includes a cover element onto which a motor that rotates the movable element relative to the base assembly is mounted, wherein the base element and the cover element are made of molded polymer, and the base element includes a hole into which the movable element fits to allow rotation of the movable element relative to the base assembly.

2. The load tap changer of claim 1 wherein:

the multiple stationary contacts include a stationary reversing contact that is connected to an end tap of the electrical control device; and the base assembly includes a reversing assembly that includes a reversing element onto which a pair of movable reversing contacts that connect the stationary reversing contact to a neutral stationary contact is mounted.

3. The load tap changer of claim 2 wherein the reversing element is made of molded polymer.

4. The load tap changer of claim 2 wherein the reversing assembly includes a mounting pole connected to the neutral stationary contact about which the reversing element rotates.

5. The load tap changer of claim 2 wherein the reversing element includes a reversing arm that is engaged to rotate the reversing element.

6. The load tap changer of claim 5 wherein the movable assembly includes a roller bearing that engages the reversing arm to rotate the reversing element.

7. The load tap changer of claim 6 wherein the reversing element includes curved edges that match the outer circumference of the movable assembly such that the reversing element is only rotated when the roller bearing engages the reversing arm.

8. The load tap changer of claim 6 wherein the roller bearing rotates about a pin that extends through the movable assembly.

9. The load tap changer of claim 2 wherein the reversing element includes a protrusion that activates logic switches mounted to the cover assembly.

10. The load tap changer of claim 2 wherein the reversing element includes stops that limit rotation of the movable assembly past maximum or minimum allowable tap positions.

11. The load tap changer of claim 1 wherein:

each of the multiple stationary contacts includes a contact face that is connected to a conducting rod;

the contact face of each of the multiple stationary contacts is mounted in a molded pocket on a front side of the base element; and the conducting rod of each of the multiple stationary contacts extends through the base element to connect one of the electrical control device taps on a back side of the base element.

12. The load tap changer of claim 11 wherein:

each conducting rod is threaded; and each conducting rod is secured to the base assembly with a nut and a washer.

13. The load tap changer of claim 1 wherein the base element includes an insulating wall to insulate the motor from the stationary and movable contacts.

14. The load tap changer of claim 1 wherein the base element includes slots that allow for fluids to flow through the base element.

15. The load tap changer of claim 1 wherein the stationary contacts are disposed in a circumferential ring around an edge of the base element.

16. The load tap changer of claim 1 wherein the stationary contacts have a tungsten-copper composite leading edge.

17. The load tap changer of claim 1 wherein the movable element is made of molded polymer.

18. The load tap changer of claim 1 wherein the movable element includes multiple Geneva gear slots molded into a top side of the movable element that are engaged to cause rotation of the movable element.

19. The load tap changer of claim 1 wherein the movable element includes multiple locking slots molded into a top side of the movable element that are engaged to prevent rotation of the movable element and to properly orient the movable assembly.

20. The load tap changer of claim 1 wherein the movable element includes a slot configured to receive a rotating component that is to rotate with the movable element.

21. The load tap changer of claim 20 wherein the rotating component is an indicator cam that indicates an orientation of the movable assembly.

22. The load tap changer of claim 1 wherein the movable element includes pivot points about which the movable element rotates.

23. The load tap changer of claim 1 wherein each end of the movable contacts have tips made from composite materials to retard erosion of the movable contacts.

24. The load tap changer of claim 23 wherein the tips are made of a tungsten-copper composite.

25. The load tap changer of claim 24 wherein parts of the movable contacts separate from the tips have single-piece, solid copper cross sections.

26. The load tap changer of claim 1 wherein two pairs of movable contacts are mounted on the movable element.

27. The load tap changer of claim 1 wherein the cover element includes a terminal block to which input control wiring is connected.

28. The load tap changer of claim 1 wherein the motor is an alternating current synchronous motor.

29. The load tap changer of claim 1 wherein a motor gear is coupled to the motor.

30. The load tap changer of claim 29 wherein the motor gear includes a hex feature that is accessible to manually rotate the motor gear.

31. The load tap changer of claim 30 wherein the hex feature is accessible through a hole in the cover element.

32. The load tap changer of 29 wherein the motor gear directly drives a Geneva drive gear mounted on the cover element that causes the movable element to rotate.

33. The load tap changer of claim 1 wherein the cover assembly includes a neutral indicating switch that is activated by a protrusion of a reversing assembly when the movable assembly is in an orientation in which a neutral tap is selected.

34. The load tap changer of claim 1 wherein the cover element includes a stabilization feature that stabilizes a reversing element as the reversing element rotates.

35. The load tap changer of claim 1 wherein the motor is electrically connected to a capacitor and to a resistor that are mounted on the cover element.

36. The load tap changer of claim 1 wherein the electrical control device is a transformer.

37. The load tap changer of claim 1 wherein the electrical control device is a step voltage regulator.

38. The load tap changer of claim 1, wherein the hole into which the moveable element fits is a through-hole.

39. A load tap changer connected to a power source to control voltage supplied from the power source to a load, the load tap changer comprising:

a base assembly that includes a base element onto which multiple stationary contacts that connect to taps of a winding of an electrical control device are mounted;

a movable assembly that includes a movable element that rotates to connect at least one pair of movable contacts mounted on the movable element to a stationary contact to select a corresponding tap; and a cover assembly that includes a cover element onto which a motor that rotates the movable element relative to the base assembly is mounted, wherein the multiple stationary contacts include a stationary reversing contact that is connected to an end tap of the electrical control device, the base assembly includes a reversing assembly that includes a reversing element onto which a pair of movable reversing contacts that connect the stationary reversing contact to a neutral stationary contact is mounted, and the reversing element includes contact pockets into which the reversing movable contacts are mounted.

40. The load tap changer of claim 39 wherein notches in the reversing movable contacts mate with side walls of the contact pockets to hold the reversing movable contacts within the contact pockets.

41. The load tap changer of claim 39 wherein the reversing assembly includes compression springs that hold the reversing movable contacts in the contact pockets of the reversing element.

42. The load tap changer of claim 41 wherein the contact pockets and the reversing movable contacts include spring retention features to hold the compression springs within the contact pockets.

43. A load tap changer connected to a power source to control voltage supplied from the power source to a load, the load tap changer comprising:

a base assembly that includes a base element onto which multiple stationary contacts that connect to taps of a winding of an electrical control device are mounted;

a movable assembly that includes a movable element that rotates to connect at least one pair of movable contacts mounted on the movable element to a stationary contact to select a corresponding tap; and a cover assembly that includes a cover element onto which a motor that rotates the movable element relative to the base assembly is mounted, wherein the base assembly includes a first stationary contact disk that connects to one end of a bridging reactor.

44. The load tap changer of claim 43 wherein the first stationary contact disk is connected to the base assembly with conducting rods.

45. The load tap changer of claim 43 wherein the base assembly includes a second stationary contact disk that connects to an opposite end of the bridging reactor.

46. The load tap changer of claim 45 wherein the first stationary contact disk and the second stationary contact disk are made of copper.

47. The load tap changer of claim 45 wherein the first stationary contact disk and the second stationary contact disk are made of plated copper.

48. The load tap changer of claim 47 wherein the first stationary contact disk and the second stationary contact disk are made of nickel-plated copper.

49. The load tap changer of 45 wherein the second stationary contact disk is connected to the base assembly on top of the first stationary contact disk such that conducting rods of the second stationary contact disk fit through holes in the first stationary contact disk.

50. The load tap changer of claim 49 wherein the conducting rods of the second stationary contact disk fit into bosses molded into the base element.

51. The load tap changer of claim 45 wherein the first stationary contact disk and the second stationary contact disk are connected to the stationary contacts by the movable contacts.

52. The load tap changer of claim 45 wherein the first stationary contact disk and the second stationary contact disk both include a hole through which the movable assembly is mated with the base assembly.

53. A load tap changer connected to a power source to control voltage supplied from the power source to a load, the load tap changer comprising:

a base assembly that includes a base element onto which multiple stationary contacts that connect to taps of a winding of an electrical control device are mounted;

a movable assembly that includes a movable element that rotates to connect at least one pair of movable contacts mounted on the movable element to a stationary contact to select a corresponding tap; and a cover assembly that includes a cover element onto which a motor that rotates the movable element relative to the base assembly is mounted, wherein the movable element includes contact pockets into which each of the movable contacts are mounted.

54. The load tap changer of claim 53 wherein the base element is made of molded polymer.

55. The load tap changer of claim 53 wherein notches in the movable contacts mate with side walls of the contact pockets to hold the movable contacts within the contact pockets.

56. The load tap changer of claim 53 wherein the movable assembly includes compression springs that hold the movable contacts in the contact pockets of the movable element.

57. The load tap changer of claim 56 wherein the movable contacts include spring retention features to hold the compression springs within the contact pockets.

58. The load tap changer of claim 53 wherein the movable assembly includes contact wearplates within the contact pockets of the movable assembly.

59. The load tap changer of claim 58 wherein the contact wearplates include spring retention features.

60. The load tap changer of claim 53 wherein the movable contacts each include a pivot on which the movable contacts rock within the contact pockets.

61. The load tap changer of claim 60 wherein compression springs of the movable assembly are located farther within the contact pockets than the pivots of the movable contacts.

62. The load tap changer of claim 53 wherein the cover element is made of molded polymer.

63. A load tap changer connected to a power source to control voltage supplied from the power source to a load, the load tap changer comprising:

a base assembly that includes a base element onto which multiple stationary contacts that connect to taps of a winding of an electrical control device are mounted;

a movable assembly that includes a movable element that rotates to connect at least one pair of movable contacts mounted on the movable element to a stationary contact to select a corresponding tap; and a cover assembly that includes a cover element onto which a motor that rotates the movable element relative to the base assembly is mounted, wherein the movable element includes stop features that encounter stops on a reversing assembly to prevent rotation of the movable assembly past maximum or minimum allowable positions.

64. A load tap changer connected to a power source to control voltage supplied from the power source to a load, the load tap changer comprising:

a base assembly that includes a base element onto which multiple stationary contacts that connect to taps of a winding of an electrical control device are mounted;

a movable assembly that includes a movable element that rotates to connect at least one pair of movable contacts mounted on the movable element to a stationary contact to select a corresponding tap; and a cover assembly that includes a cover element onto which a motor that rotates the movable element relative to the base assembly is mounted, wherein the motor drives a Geneva drive gear mounted on the cover element that drives the movable element to rotate relative to the base assembly.

65. The load tap changer of claim 64 wherein the Geneva drive gear and the movable element are configured such that a 360° rotation of the Geneva drive gear produces a 20° rotation of the movable element.

66. The load tap changer of claim 64 wherein the Geneva drive gear includes a pin that engages Geneva gear slots on the movable element to drive the rotation of the movable element relative to the base assembly.

67. The load tap changer of claim 66 wherein the pin of the Geneva drive gear includes a hardened steel pin and a hardened steel roller that rotates about the hardened steel pin.

68. The load tap changer of claim 64 wherein the Geneva drive gear includes a locking feature that mates with locking slots on the movable element to prevent the movable element from rotating and to properly orient the movable assembly.

69. The load tap changer of claim 68 wherein the locking feature is made of polymer.

70. A load tap changer connected to a power source to control voltage supplied from the power source to a load, the load tap changer comprising:

a base assembly that includes a base element onto which multiple stationary contacts that connect to taps of a winding of an electrical control device are mounted;

a movable assembly that includes a movable element that rotates to connect at least one pair of movable contacts mounted on the movable element to a stationary contact to select a corresponding tap; and a cover assembly that includes a cover element onto which a motor that rotates the movable element relative to the base assembly is mounted, wherein the cover assembly includes (i) a polymer position indicator cam rotated by the motor from which a pin extends, (ii) a polymer position indicator Geneva gear that rotates in response to the pin of the position indicator cam entering and exiting slots on the position indicator Geneva gear as the position indicator cam rotates, and (iii) a position indicator tube that rotates as the position indicator Geneva gear rotates to move an indicator on a dial of the position indicator.

71. The load tap changer of claim 70 wherein a Geneva drive gear has a molded shaft that extends through the cover element and mates with the position indicator cam to couple the rotation of the position indicator cam to the Geneva drive gear.

72. A load tap changer connected to a power source to control voltage supplied from the power source to a load, the load tap changer comprising:

a base assembly that includes a base element onto which multiple stationary contacts that connect to taps of a winding of an electrical control device are mounted;

a movable assembly that includes a movable element that rotates to connect at least one pair of movable contacts mounted on the movable element to a stationary contact to select a corresponding tap; and a cover assembly that includes a cover element onto which a motor that rotates the movable element relative to the base assembly is mounted, wherein the cover assembly includes limit switches and logic switches that de-energize the motor to prevent the movable element from rotating into mechanical stops.

73. The load tap changer of claim 72 wherein the limit switches are activated by an indicator cam inserted into a slot in the center of the movable element.

74. The load tap changer of claim 73 wherein the limit switches are included in a limit switch module that includes a dial on which an indicator arrow on the indicator cam indicates a currently selected tap.

75. The load tap changer of claim 72 wherein the logic switches are activated by a protrusion of a reversing assembly.

76. A load tap changer connected to a power source to control voltage supplied from the power source to a load, the load tap changer comprising:

a base assembly that includes a base element onto which multiple stationary contacts that connect to taps of a winding of an electrical control device are mounted;

a movable assembly that includes a movable element that rotates to connect at least one pair of movable contacts mounted on the movable element to a stationary contact to select a corresponding tap; and a cover assembly that includes a cover element onto which a motor that rotates the movable element relative to the base assembly is mounted, wherein the cover element and the base element include electrical barriers that provide minimal clearance between live components and grounded support features.

77. A method for selecting a tap of an electrical control device with a load tap changer, the method comprising:

providing a base assembly that includes a base element onto which stationary contacts connected to taps of a tapped section of an electrical control device are mounted;

receiving a signal from a control apparatus of the electrical control device to select a tap of the electrical control device;

energizing a motor mounted on a cover element of a cover assembly and coupled to the control apparatus in response to the signal;

rotating a motor gear mounted on an output device of the motor in response to the energization of the motor;

rotating a Geneva drive gear mounted on the cover element in response to the rotation of the motor gear; and rotating a movable assembly that includes a movable element onto which movable contacts are mounted relative to the base assembly in response to the rotation of the Geneva drive gear to cause the movable contacts to engage the stationary contacts, thereby selecting a tap connected to the electrical control device.

78. The method of claim 77 wherein rotating the motor gear in response to the energization of the motor comprises rotating the motor gear in a direction indicated by the signal in response to the energization of the motor.

79. The method of claim 77 wherein rotating the movable assembly relative to the base assembly in response to the rotation of the Geneva drive gear comprises:

engaging a pin on the Geneva drive gear with a Geneva gear slot on the movable element;

rotating the movable assembly in response to motion of the pin;

engaging a locking feature of the Geneva drive gear with a locking slot on the movable element; and preventing rotation of the movable assembly when the locking feature is engaged with the locking slot.

80. The method of claim 77 further comprising activating holding switches mounted on the cover element that cause the motor to remain energized after the signal from the control apparatus is removed.

81. The method of claim 80 further comprising deactivating the holding switches to de-energize the motor after the tap has been selected.

82. The method of claim 77 further comprising driving a position indicator in response to the rotation of the movable assembly.

83. The method of claim 82 wherein driving a position indicator in response to the rotation of the movable assembly comprises:

rotating a position indicator cam mounted on the cover element and driven by the motor;

rotating a position indicator Geneva gear mounted on the cover element in response to the rotation of the position indicator cam;

rotating a position indicator tube mounted on the cover element in response to the rotation of the position indicator Geneva gear; and updating a position indicated by the position indicator in response to the rotation of the position indicator tube.

84. The method of claim 77 wherein rotating the movable assembly relative to the base assembly comprises:

rotating the movable assembly until one pair of movable contacts has disengaged from a previously engaged stationary contact; and rotating the movable assembly until the one pair of movable contacts has engaged with an adjacent stationary contact.

85. The method of claim 77 further comprising rotating a reversing assembly relative to the base assembly to change a polarity of the tapped section of the electrical control device.

86. The method of claim 85 wherein rotating the reversing assembly comprises:

engaging a bearing on the movable assembly with an arm on the reversing assembly;

moving the bearing as the movable assembly rotates; and rotating the reversing assembly in response to the motion of the bearing.

87. The method of claim 85 further comprising connecting stationary reversing contacts connected to end taps of the tapped section to a neutral stationary contact connected to a neutral tap of the tapped section with movable reversing contacts included in the reversing assembly.

88. The method of claim 77 further comprising de-energizing the motor when the movable assembly has rotated to a maximum allowable position.

89. The method of claim 88 wherein de-energizing the motor when the movable assembly has rotated to a maximum allowable position comprises:

using limit switches and logic switches mounted on the cover element to determine when the movable assembly has rotated to the maximum allowable position; and de-energizing the motor when the limit switches and logic switches indicate that the movable assembly has rotated to the maximum allowable position.

* * * * *